US011976650B2

(12) United States Patent
Jeon et al.

(10) Patent No.: US 11,976,650 B2
(45) Date of Patent: May 7, 2024

(54) COMPRESSOR AND MANUFACTURING METHOD THEREOF

(71) Applicant: LG Electronics Inc., Seoul (KR)

(72) Inventors: Wooju Jeon, Seoul (KR); Youngpil Kim, Seoul (KR); Kyungmin Lee, Seoul (KR); Sangik Son, Seoul (KR)

(73) Assignee: LG Electronics Inc., Seoul (KR)

( * ) Notice: Subject to any disclaimer, the term of this patent is extended or adjusted under 35 U.S.C. 154(b) by 275 days.

(21) Appl. No.: 17/091,546

(22) Filed: Nov. 6, 2020

(65) Prior Publication Data

US 2021/0140424 A1 May 13, 2021

(30) Foreign Application Priority Data

Nov. 8, 2019 (KR) ..... 10-2019-0142294

(51) Int. Cl.
*F04B 53/14* (2006.01)
*F04B 53/16* (2006.01)

(52) U.S. Cl.
CPC ..... *F04B 53/14* (2013.01); *F04B 53/162* (2013.01); *F04B 2201/02* (2013.01)

(58) Field of Classification Search
CPC ..... F04B 53/14; F04B 53/162; F04B 2201/02
See application file for complete search history.

(56) References Cited

U.S. PATENT DOCUMENTS 771,037 A * 9/1904 Beck ..... F02B 61/02 123/43 AA
832,956 A * 10/1906 Castelnau ..... F04B 39/045 92/112
2,300,009 A * 10/1942 Rose ..... F01B 3/0085 92/162 R
3,106,138 A * 10/1963 Thoma ..... F01B 3/0085 184/18
3,521,531 A * 7/1970 Kaeselmodel ..... F16J 9/203 92/158
4,508,070 A * 4/1985 Buggert ..... F02B 41/00 204/192.32
4,809,652 A * 3/1989 Essig ..... F02F 3/022 123/193.6

(Continued)

FOREIGN PATENT DOCUMENTS

DE 202006002338 U1 * 11/2006 ..... E05F 3/10
DE 102005059031 A1 * 6/2007 ..... F02M 41/1405

(Continued)

OTHER PUBLICATIONS

Korean Office Action in Korean Application No. 10-2019-0142294, dated Aug. 20, 2020, 10 pages (with English translation).

*Primary Examiner* — Thomas Fink
(74) *Attorney, Agent, or Firm* — Fish & Richardson P.C.

(57) ABSTRACT

A compressor and a method of manufacturing the same are disclosed. The compressor includes a piston having formed therein a suction space, in which refrigerant gas is sucked; and a cylinder in which a piston is accommodated, the cylinder defining a compression space that is configured, based on the piston reciprocating in an axial direction, to compress the refrigerant gas therein. A plurality of grooves having a partial spherical shape and having a diameter of 10 micrometers is formed in an outer circumferential surface of the piston or an inner circumferential surface of the cylinder.

11 Claims, 22 Drawing Sheets

(56) References Cited

U.S. PATENT DOCUMENTS

| | | | | |
|---|---|---|---|---|
| 6,279,454 | B1 * | 8/2001 | Nishioka | F02M 59/445 92/172 |
| 6,477,940 | B1 * | 11/2002 | Danckert | F02M 59/44 92/162 R |
| 6,547,534 | B1 * | 4/2003 | Sakamoto | F04B 27/053 417/244 |
| 8,381,696 | B2 * | 2/2013 | Urabe | F16J 10/04 123/193.2 |
| 8,789,509 | B2 * | 7/2014 | Sasaki | C10M 111/04 123/193.6 |
| 9,341,267 | B2 * | 5/2016 | Kim | F16J 10/04 |
| 9,759,325 | B2 * | 9/2017 | Oh | F16J 10/02 |
| 11,111,875 | B2 * | 9/2021 | Urabe | F16J 9/12 |
| 2002/0090155 | A1 * | 7/2002 | Ushijima | F16C 33/106 384/293 |
| 2010/0288222 | A1 * | 11/2010 | Urabe | F16J 10/04 123/193.2 |
| 2015/0192063 | A1 * | 7/2015 | Chang | F02F 1/20 123/193.2 |
| 2017/0204842 | A1 * | 7/2017 | Morton | F16N 31/00 |
| 2017/0314542 | A1 * | 11/2017 | Ha | F04B 35/04 |

FOREIGN PATENT DOCUMENTS

| | | |
|---|---|---|
| JP | 2007284706 | 11/2007 |
| KR | 1020150040027 | 4/2015 |
| KR | 1020160024217 | 3/2016 |
| KR | 1020170123042 | 11/2017 |

* cited by examiner (a)

(b)

(a)

(b)

COMPRESSOR AND MANUFACTURING METHOD THEREOF

CROSS-REFERENCE TO RELATED APPLICATION

This application is based on and claims the benefit of priority to Korean Patent Application No. 10-2019-0142294, filed on Nov. 8, 2019, in the Korean Intellectual Property Office, the disclosure of which is incorporated herein in its entirety by reference.

TECHNICAL FIELD

The present disclosure relates to a compressor and a method of manufacturing the same. More specifically, the present disclosure relates to a linear compressor for compressing refrigerant by linear reciprocating motion of a piston and a method of manufacturing the same.

BACKGROUND

In general, a compressor refers to an apparatus for receiving power from a power generation apparatus such as a motor or a turbine and compressing working fluid such as air or refrigerant. Compressors are widely being applied to overall industry or home appliances and, more particularly, a steam compression refrigeration cycle (hereinafter referred to as a refrigeration cycle).

Such compressors may be classified into a reciprocating compressor, a rotary compressor and a scroll compressor according to the method of compressing refrigerant.

In the reciprocating compressor, a compression space is formed between a piston and a cylinder and the piston linearly reciprocates to compress fluid. In the rotary compressor, fluid is compressed by a roller eccentrically rotated inside a cylinder. In the scroll compressor, a pair of spiral scrolls is rotated in a state of being engaged with each other to compress fluid.

Recently, among reciprocating compressors, use of linear compressors using reciprocating motion without using a crank shaft is gradually increasing. The linear compressor has advantages such as improved compressor efficiency due to little mechanical loss occurring upon switching from rotational motion to reciprocating motion and a relatively simple structure.

The linear compressor may be configured such that a cylinder is located inside a casing forming a closed space to form a compression chamber and a piston covering the compression chamber reciprocates inside the cylinder. In the linear compressor, a process of sucking fluid in the closed space into the compression chamber while the piston is located at a bottom dead center (BDC) and compressing and discharging fluid in the compression chamber when the piston is located at a top dead center (TDC) is repeated.

A compression unit and a driving unit are respectively installed inside the linear compressor, and the compression unit performs a process of compressing and discharging the refrigerant while performing resonant motion by a resonance spring through movement generated in the driving unit.

The linear compressor repeatedly performs a series of processes of sucking the refrigerant into the casing through a suction pipe while the piston reciprocates at a high speed inside the cylinder by the resonance spring, discharging the refrigerant from the compression space through the forward motion of the piston, and moving the refrigerant to a condenser through a discharge pipe.

Meanwhile, the linear compressors may be classified into oil lubricated linear compressors and gas type linear compressors according to the lubrication method.

As disclosed in Patent Document 1 (Korean Patent Laid-Open Publication No. 10-2015-0040027), the oil lubricated linear compressor is configured to lubricate a cylinder and a piston using oil by storing a certain amount of oil in a casing. On the other hand, as disclosed in Patent Document 2 (Korean Patent Laid-Open Publication No. 10-2016-0024217), the gas lubricated linear compressor guides some of refrigerant discharged from a compression space between a cylinder and a piston without storing oil inside a casing to lubricate the cylinder and the piston with the gas power of the refrigerant.

In the oil lubricated linear compressor, as oil having a relatively low temperature is supplied between the cylinder and the piston, it is possible to suppress overheating of the cylinder and the piston due to motor heat or compression heat. Therefore, the oil lubricated linear compressor can prevent the occurrence of suction loss by suppressing an increase in specific volume due to heating while the refrigerant passing through a suction flow path of the piston is sucked into the compression chamber of the cylinder.

However, in the oil lubricated linear compressor, if the oil discharged to a refrigeration cycle device along with the refrigerant is not smoothly recovered to the compressor, oil shortage may occur inside the casing of the compressor, thereby deteriorating reliability of the compressor.

On the other hand, the gas lubricated linear compressor is advantageous in that miniaturization is possible as compared to the oil lubricated linear compressor, and reliability of the compressor does not deteriorate due to oil shortage because the cylinder and the piston are lubricated using the refrigerant.

As described above, in the conventional gas lubricated linear compressor, the thread is wound around the inlet of the supply port through which lubricating gas flows into the cylinder to prevent inflow of dirt.

Referring to FIG. 2, in both the oil lubricated linear compressor and the gas lubricated linear compressor, if a piston misalignment occurs in the piston, the piston reciprocates inside the cylinder in a state of being eccentric or inclined. When the piston comes into contact with the cylinder, abrasion occurs in the piston and the cylinder to generate particles, and damage may be caused when fatigue is accumulated.

Meanwhile, as the pressure of the lubrication surface is applied to the piston, the piston may not be brought into contact with the cylinder. The limit of the magnitude of this pressure is determined by the shape of the piston and the cylinder, and, when large external force is generated, contact between the piston and the cylinder may occur. In addition, when the shape of the lubrication surface is changed, such as an increase in the gap between the piston and the cylinder as frictional abrasion occurs locally, the floating ability of the piston may decrease.

In order to reduce abrasion of the piston and the cylinder due to such contact, coatings such as anodizing, diamond like carbon coating (DLC) or Teflon are applied to the surface of the piston and the cylinder. This increases a time and cost for the coating process. In addition, additional processing is required to meet tolerance after coating, causing a problem in terms of production efficiency.

RELATED ART (Patent Document 1) Korean Patent Laid-Open Publication No. KR10-2015-0040027 A (published on Apr. 14, 2015)

(Patent Document 2) Korean Patent Laid-Open Publication No. KR10-2016-0024217 A (published on Mar. 4, 2016)

SUMMARY

An object of the present disclosure is to provide a compressor capable of improving durability of abrasion of a lubrication surface, reducing friction loss, and improving compression reliability, by preventing abrasion of a piston or a cylinder occurring when the piston reciprocates inside the cylinder in a misalignment state, such as an eccentric and inclined state, of the piston in the coupling structure of the piston and the cylinder, and a method of manufacturing the same.

Another object of the present disclosure is to provide a compressor capable of preventing oil from flowing into a sliding part, and a method of manufacturing the same.

Another object of the present disclosure is to provide a compressor capable of performing a filter function while performing a restrictor function for reducing the pressure of refrigerant flowing into a cylinder in a gas bearing system through change of the shape of the cylinder or a frame, and a method of manufacturing the same.

Particular implementations of the present disclosure provide a compressor that includes a piston that defines a suction space configured to suction a refrigerant gas, and a cylinder that receives the piston and defines a compression space that is configured to compress, based on reciprocation of the piston in an axial direction, the refrigerant gas therein. A plurality of grooves may be defined at an outer circumferential surface of the piston or an inner circumferential surface of the cylinder. The plurality of grooves each may have a partial spherical shape and have a diameter of 10 micrometers or less.

In some implementations, the compressor can optionally include one or more of the following features. The plurality of grooves that are defined at the outer circumferential surface of the piston may be defined in a circumferential direction of the piston and in a longitudinal direction of the piston. The plurality of grooves that are defined at the inner circumferential surface of the cylinder may be defined in a circumferential direction of the cylinder and in a longitudinal direction of the cylinder. The compressor may include a frame that receives the cylinder. The piston may be configured to move to perform a compression cycle and a suction cycle. The piston may include a head that defines a suction port that fluidly communicates with the suction space and the compression space, and a guide that faces the inner circumferential surface of the cylinder and has a cylindrical shape. The cylinder may include a body that defines a piston space that receives the piston, and a flange that is located at a first end of the body and that is coupled with the frame. The plurality of grooves that are defined at the outer circumferential surface of the piston may be defined at (i) a first outer region of the piston adjacent to the head, (ii) a second outer region of the piston that corresponds to a second end of the body of the cylinder based on the piston being in the compression cycle, and (iii) a third outer region of the piston that is adjacent to the second end of the body of the cylinder based on the piston being in the compression cycle. The second end of the body is opposite to the first end of the body. The piston may be configured to move to perform a compression cycle and a suction cycle. The piston may include a head that defines a suction port that fluidly communicates with the suction space and the compression space, and a guide that faces the inner circumferential surface of the cylinder and has a cylindrical shape. The cylinder may include a body that defines a piston space that receives the piston, and a flange that is located at a first end of the body and that is coupled with the frame. The plurality of grooves that are defined at the inner circumferential surface of the cylinder may be defined at (i) a first inner region of the cylinder that corresponds to a first end of the guide of the piston based on the piston being in the compression cycle, (ii) a second inner region of the cylinder that is adjacent to the first end of the guide of the piston based on the piston being in the compression cycle, and (iii) a third inner region of the cylinder that is adjacent to a second end of the body that is opposite to the first end of the body. The cylinder may include a gas inflow passage that fluidly communicates with a gas pocket at a side of the gas inflow passage outside the cylinder and that fluidly communicates with an internal space of the cylinder at an opposite side of the gas inflow passage. The gas inflow passage may be configured to permit at least part of the refrigerant gas to flow into the compression space. The gas inflow passage may include a first gas inflow passage that is disposed at a first portion of the cylinder, and a second gas inflow passage that is spaced apart from the first gas inflow passage in the axial direction. At least some of the plurality of grooves may be defined at a portion of the first gas inflow passage and at a portion of the second gas inflow passage. The compressor may include a frame that receives the cylinder. A gas pocket may be defined between an inner circumferential surface of the frame and an outer circumferential surface of the cylinder, and be configured to allow the refrigerant gas to flow through the gas pocket. The frame may include a gas hole that (i) fluidly communicates with an outside of the frame at a side of the gas hole and that allows the refrigerant gas to flow into the outside of the frame, and (ii) fluidly communicates with the gas pocket at an opposite side of the gas hole. The cylinder may include a gas inlet that fluidly communicates with the gas pocket at a side of the gas inlet and that fluidly communicates with the internal space of the cylinder at an opposite side of the gas inlet. A distance between the inner circumferential surface of the frame and the outer circumferential surface of the cylinder that define the gas pocket may be in a range of 10 to 30 micrometers. The frame may include a frame body that receives the cylinder and that has a cylindrical shape, and a frame flange that extends radially outward from a first portion of the frame body and that is connected with a driver configured to move the piston. The gas hole may have a first side that fluidly communicates with the first portion of the frame flange and a second side that is opposite to the first side of the gas hole and fluidly communicates with an inside of the frame body. The compressor may include a first sealing member that is disposed between the cylinder and the frame at a first portion of the gas hole and that is configured to seal a first portion of the gas pocket. The compressor may include a second sealing member that is disposed between the cylinder and the frame at a second portion of the gas hole and that is configured to seal a second portion of the gas pocket. The gas pocket may include a gas space between the first sealing member and the second sealing member. A plurality of gas inlets may be recessed at the outer circumferential surface of the cylinder and be disposed in the axial direction. At least one of the plurality of gas inlets may at least partially overlap the opposite side of the gas hole. Each of the plurality of gas inlets may extend in a circumferential direction along the outer circumferential surface of the cylinder. The cylinder may further include a plurality of gas receiving grooves that fluidly communicate with the gas inlets, that are recessed at the inner circumferential surface of the cylinder, and that extend in the axial direction. The plurality of gas receiving grooves may circumferentially extend along the inner circumferential surface of the cylinder at an angle of 180 degrees or less with respect to a central axis of the cylinder. The plurality of gas receiving grooves may be arranged in a concave curved shape with a radius of curvature less than a radius of curvature of the inner circumferential surface of the cylinder. The plurality of gas receiving grooves may be provided in the axial direction and is offset from each other in the axial direction.

Particular implementations of the present disclosure provide a method of manufacturing the compressor. The compressor may include a piston that defines a suction space configured to suction a refrigerant gas, and a cylinder that receives the piston and defines a compression space that is configured to compress, based on reciprocation of the piston in an axial direction, the refrigerant gas therein. A plurality of grooves may be defined at an outer circumferential surface of the piston or an inner circumferential surface of the cylinder. The plurality of grooves each may have a partial spherical shape and have a diameter of 10 micrometers or less. The method may include spraying a plurality of spherical bodies to the outer circumferential surface of the piston or the inner circumferential surface of the cylinder such that a plurality of grooves are formed at the outer circumferential surface of the piston or the inner circumferential surface of the cylinder. The plurality of spherical bodies may have a diameter of 40 to 200 micrometers.

Particular implementations of the present disclosure provide a method of manufacturing the compressor. The compressor may include a piston that defines a suction space configured to suction a refrigerant gas, and a cylinder that receives the piston and defines a compression space that is configured to compress, based on reciprocation of the piston in an axial direction, the refrigerant gas therein. A plurality of grooves may be defined at an outer circumferential surface of the piston or an inner circumferential surface of the cylinder. The plurality of grooves each may have a partial spherical shape and have a diameter of 10 micrometers or less. The method may include spraying a plurality of spherical bodies to the outer circumferential surface of the piston or the inner circumferential surface of the cylinder such that a plurality of grooves are formed at the outer circumferential surface of the piston or the inner circumferential surface of the cylinder.

In some implementations, the method can optionally include one or more of the following features. The plurality of grooves each may have a diameter of 10 micrometers or less. The plurality of spherical bodies each may have a diameter of 10 to 40 micrometers. The plurality of grooves each may have a diameter that ranges between 1 micrometer and 10 micrometers.

The compressor according to an embodiment of the present disclosure includes a piston having formed therein a suction space, in which refrigerant gas is sucked; and a cylinder in which a piston is accommodated, the cylinder defining a compression space that is configured, based on the piston reciprocating in an axial direction, to compress the refrigerant gas therein. A plurality of grooves having a partial spherical shape and having a diameter of 10 micrometers is formed in an outer circumferential surface of the piston or an inner circumferent surface of the cylinder.

At this time, the plurality of grooves formed in the outer circumferential surface of the piston may be formed in a circumferential direction of the piston and in a longitudinal direction of the piston.

The plurality of grooves formed in the inner circumferential surface of the cylinder may be formed in a circumferential direction of the cylinder and in a longitudinal direction of the cylinder.

Here, the piston may move to a top dead center (TDC), in which a volume of the compression space is minimized, to perform a compression cycle and move to a bottom dead center (BDC), in which the volume of the compression space is maximized, to perform a suction cycle, a frame for receiving the cylinder may be further included, the piston may include a head having a suction port for communicating with the suction space and the compression space and a guide located behind the head to face the inner circumferential surface of the cylinder and having a cylindrical shape, wherein the cylinder may include a body forming a space, in which the piston is received, and a flange located at a front end of the body and coupled with the frame, and the plurality of grooves formed in the outer circumferential surface of the piston may be formed in a front outer region adjacent to the head, and may be formed in a rear outer region of the piston corresponding to a rear end of the body of the cylinder and a region adjacent thereto when the piston is in the compression cycle.

Alternatively, the piston may move to a top dead center (TDC), in which a volume of the compression space is minimized, to perform a compression cycle and move to a bottom dead center (BDC), in which the volume of the compression space is maximized, to perform a suction cycle, the piston may include a head having a suction port for communicating with the suction space and the compression space and a guide located behind the head to face the inner circumferential surface of the cylinder and having a cylindrical shape, the cylinder may include a body forming a space, in which the piston is received, and a flange located at a front end of the body and coupled with the frame, and the plurality of grooves formed in the inner circumferential surface of the cylinder may be formed in a front inner region of the cylinder corresponding to a front end of the guide of the piston and adjacent thereto when the piston is in the compression cycle, and may be formed in a rear inner region adjacent to a rear end of the body.

The cylinder may include a gas inflow passage having one side communicating with a gas pocket outside the cylinder and the other side communicating with an internal space of the cylinder to allow some of refrigerant gas compressed in the compression space to flow thereinto, the gas inflow passage may include a front gas inflow passage disposed at a front portion in an axial direction and a rear gas inflow passage disposed behind the front gas inflow passage in the axial direction, and at least some of the plurality of grooves may be disposed at a front portion of the front gas inflow passage and at a rear portion of the rear gas inflow passage.

The compressor may further include a frame for receiving the cylinder, a gas pocket, through which refrigerant gas flows, may be formed between an inner circumferential surface of the frame and an outer circumferential surface of the cylinder, the frame may include a gas hole having one side communicating with an outside to allow refrigerant gas to flow thereinto and the other side communicating with the gas pocket, the cylinder may include a gas inlet having one side communicating with the gas pocket and the other side communicating with the internal space of the cylinder, and the gas pocket may be provided such that a distance between the inner circumferential surface of the frame and the outer circumferential surface of the cylinder is in a range of 10 to 30 micrometers.

The frame may include a frame body for receiving the cylinder and having a cylindrical shape and a frame flange extending radially outward from a front portion of the frame body and connected with a driving unit for driving the piston, and the gas hole may have one side communicating with the front portion of the frame flange and the other side communicating with an inside of the frame body.

The compressor may further include a front sealing member interposed between the cylinder and the frame at a front portion of the gas hole to seal the front portion of the gas pocket, and a rear sealing member disposed between the cylinder and the frame at a rear portion of the gas hole to seal the rear portion of the gas pocket, and the gas pocket may be defined as a space between the front sealing member and the rear sealing member.

A plurality of gas inlets may be recessed radially inward from the outer circumferential surface of the cylinder and may be provided in an axial direction of the cylinder, and any one of the plurality of gas inlets may be provided to partially overlap the other side of the gas hole.

The gas inlet may extend in a circumferential direction along the outer circumferential surface of the cylinder.

At this time, the cylinder may further include a plurality of gas receiving grooves communicating with the gas inlets, recessed radially outward from the inner circumferential surface of the cylinder and provided in a axial direction of the cylinder.

The gas receiving grooves may extend in a circumferential direction at an angle of 180 degrees or less with respect to a central axis along the inner circumferential surface of the cylinder.

At this time, the gas receiving grooves may be formed in a concave curved shape with a radius of curvature less than that of the inner circumferential surface of the cylinder.

The plurality of gas receiving grooves may be provided in the axial direction and may be disposed to be unaligned in a direction parallel to the axial direction.

In a method of manufacturing the compressor according to another aspect of the present disclosure, a plurality of grooves having a partial spherical shape and having a diameter of 10 micrometers or less may be formed in an outer circumferential surface of the piston or an inner circumferential surface of the cylinder, by spraying a plurality of spherical bodies having a diameter of 40 to 200 micrometers to the outer circumferential surface of the piston or the inner circumferential surface of the cylinder.

Alternatively, a plurality of grooves having a partial spherical shape and having a diameter of 10 micrometers or less may be formed in an outer circumferential surface of the piston or an inner circumferential surface of the cylinder, by spraying a plurality of spherical bodies having a diameter of 10 to 40 micrometers to the outer circumferential surface of the piston or the inner circumferential surface of the cylinder.

DETAILED DESCRIPTION

Hereinafter, the embodiments of the present disclosure will be in detail with reference to the accompanying drawings. Throughout the drawings, the same or similar components may be provided with the same reference numbers and description thereof will not be repeated.

In describing the embodiments disclosed in the present disclosure, when a component is referred to as being "coupled" or "connected" to another component, the component may be directly coupled or connected to the other component or intervening components may also be present therebetween.

In describing the present disclosure, if it is determined that the detailed description of a related known function or construction renders the scope of the present disclosure unnecessarily ambiguous, the detailed description thereof will be omitted. The accompanying drawings are used to help easily understood the technical idea of the present disclosure and it should be understood that the idea of the present disclosure is not limited by the accompanying drawings. It is to be understood that all changes, equivalents, and substitutes are included in the spirit and scope of the present disclosure.

Meanwhile, the term disclosure may be replaced with the terms document, specification or description.

Figure 1:
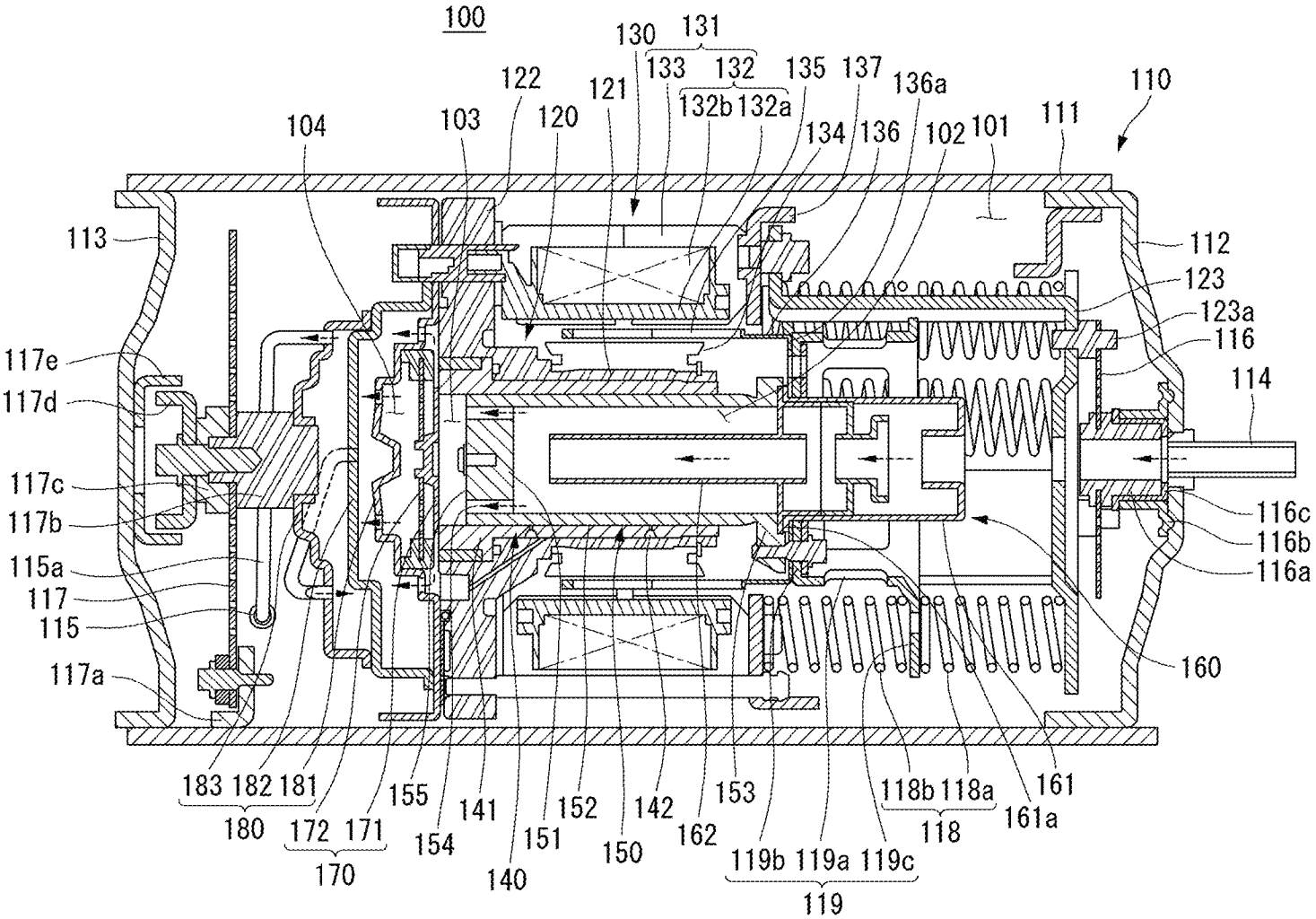
FIG. 1 is a cross-sectional view illustrating the structure of a compressor.

FIG. 1 is a cross-sectional view illustrating the structure of a compressor 100.

Hereinafter, it is assumed that the compressor according to the present disclosure is, for example, a linear compressor for sucking and compressing a fluid while a piston linearly reciprocates and discharging the compressed fluid.

The linear compressor may be a component of a refrigeration cycle and the fluid compressed in the linear compressor may be refrigerant circulating in the refrigeration cycle. The refrigeration cycle includes a condenser, an expansion device and an evaporator in addition to the compressor. In addition, the linear compressor may be used as a component of a cooling system of a refrigerator and may be widely used in the overall industry, without being limited thereto.

Referring to FIG. 1, the compressor 100 includes a casing 110 and a main body accommodated in the casing 110. The main body includes a frame 120, a cylinder 140 fixed to the frame 120, a piston 150 which linearly reciprocates inside the cylinder 140, and a driving unit 130 fixed to the frame 120 to apply driving force to the piston 150. Here, the cylinder 140 and the piston 150 may be referred to as compression units 140 and 150.

The compressor 100 may include a bearing unit for reducing friction between the cylinder 140 and the piston 150. The bearing unit may be an oil bearing or a gas bearing. Alternatively, a mechanical bearing may be used as the bearing unit.

The main body of the compressor 100 may be elastically supported by support springs 116 and 117 installed at both ends of the casing 110. The support springs include a first support spring 116 supporting the rear side of the main body and a second support spring 117 supporting the front side of the main body, and may be leaf springs. The support springs 116 and 117 may absorb vibrations and shocks generated by reciprocating motion of the piston 150 while supporting the internal parts of the main body.

The casing 110 may form an enclosed space, and the enclosed space may include a receiving space 101 in which the sucked refrigerant is received, a suction space 102 filled with refrigerant before being compressed, a compression space 103 for compressing refrigerant, and a discharge space 104 filled with the compressed refrigerant.

That is, the refrigerant sucked from a suction pipe 114 connected to the rear side of the casing 110 is filled in the receiving space 101, and the refrigerant in the suction space 102 communicating with the receiving space 101 is compressed in the compression space 103, discharged to the discharge space 104 and discharged to the outside through a discharge pipe 115 connected to the front side of the casing 110.

The casing 110 may include a shell 111 having both opened ends and formed in a long cylindrical shape in a substantially transverse direction, a first shell cover 112 coupled to the rear side of the shell 111 and a second shell cover 113 coupled to the front side of the shell. Here, the front side means the left of the drawing, that is, a direction in which the compressed refrigerant is discharged, and the rear side means the right side of the drawing, that is, a direction in which the refrigerant is introduced. In addition, the first shell cover 112 or the second shell cover 113 may be formed integrally with the shell 111.

The casing 110 may be formed of a thermally conductive material. Therefore, heat generated in an internal space of the casing 110 may be rapidly radiated to the outside.

The first shell cover 112 may be coupled to the shell 111 to seal the rear side of the shell 111, and a suction pipe 114 may be inserted into and coupled to the center of the first shell cover 112.

The rear side of the main body of the compressor may be elastically supported by the first shell cover 112 through the first support spring 116 in a radial direction.

The first support spring 116 may be a circular leaf spring, an edge of which may be supported by a back cover 123 through a support bracket 123*a* in a front direction, and an opened central portion of which may be supported by the first shell cover 112 through a suction guide 116*a* in a rear direction.

A suction guide 116*a* is formed in a cylindrical shape and has a penetration flow path provided therein. The suction guide 116*a* has a front outer circumferential surface, to which the central opening of the first support spring 116 is coupled, and a rear end supported by the first shell cover 112. At this time, a separate suction-side support member 116*b* may be interposed between the suction guide 116*a* and the inner surface of the first shell cover 112.

The rear side of the suction guide 116*a* may communicate with the suction pipe 114. The refrigerant sucked through the suction pipe 114 may smoothly flow into a muffler unit 160 described below through a suction guide 116*a*.

A damping member 116*c* made of a rubber material may be installed between the suction guide 116*a* and the suction-side support member 116*b*. Therefore, it is possible to prevent vibrations which may occur while the refrigerant is sucked through the suction pipe 114 from being transmitted to the first shell cover 112.

The second shell cover 113 may be coupled to the shell 111 to seal the front side of the shell 111, and a discharge pipe 115*a* may be inserted and coupled through a loop pipe 115*a*. The refrigerant discharged from the compression space 103 may be discharged to the refrigeration cycle through the loop pipe 115*a* and the discharge pipe 115 after passing through a discharge cover assembly 180.

The front side of the main body of the compressor may be elastically supported by the shell 111 or the second shell cover 113 in the radial direction through the second support spring 117.

The second support spring 117 may be a circular leaf spring, an opened central portion of which may be supported by the discharge cover assembly 180 in the rear direction through a first support guide 117*b* and an edge of which may be supported on the inner surface of the shell 111 or the inner surface of the shell 111 adjacent to the second shell cover 113 in the radial direction by the support bracket 117*a*. Alternatively, unlike the drawing, the edge of the second support spring 117 may be supported by the second shell cover 113 in the front direction through a bracket (not shown).

The first support guide 117*b* is formed in a cylindrical shape with different diameters, a front side thereof may be inserted into the central opening of the second support spring 117, and a rear side thereof may be inserted into the central opening of the discharge cover assembly 180. A support cover 117*c* may be coupled to the front side of the first support guide 117*b* with the second support spring 117 interposed therebetween. The front side of the support cover 117*c* may be coupled with a second support guide 117*d* which is concave forward and has a cup shape and the inside of the second shell cover 113 may be coupled with a third support guide 117*e* which corresponds to the second support guide 117*d*, is concave backward and has a cup shape. The second support guide 117*d* may be inserted into the third support guide 117*e* to be supported in an axial direction and a radial direction. At this time, a gap may be formed between the second support guide 117*d* and the third support guide 117*e*.

The frame 120 includes a body 121 supporting the outer circumferential surface of the cylinder 140 and a flange 122 connected to one side of the body 121 to support the driving unit 130. The frame 120 may be supported on the casing 110 by the first support spring 116 and the second support spring 117 along with the driving unit 130 and the cylinder 140.

The body 121 may be formed in a cylindrical shape to surround the outer circumferential surface of the cylinder 140, and the flange 122 may be formed to extend from the front end of the body 121 in the radial direction.

The inner circumferential surface of the body 121 may be coupled with the cylinder 140, and the outer circumferential surface thereof may be coupled with an inner stator 134. For example, the cylinder 140 may be fixed by press-fitting into the inner circumferential surface of the body 121 and the inner stator 134 may be fixed using a fixing ring.

The rear surface of the flange 122 may be coupled with an outer stator 131 and the front surface thereof may be coupled with the discharge cover assembly 180. For example, the outer stator 131 and the discharge cover assembly 180 may be fixed through a mechanical coupling unit.

A bearing inlet groove 125*a* forming a portion of the gas bearing is formed in one side of the front surface of the flange 122, a bearing communication hole 125*b* penetrating from the bearing inlet groove 125*a* to the inner circumferential surface of the body 121 may be formed, and a gas groove 125*c* communicating with the bearing communication hole 125*b* may be formed in the inner circumferential surface of the body 121.

The bearing inlet groove 125*a* may be formed to be recessed by a predetermined depth in the axial direction, and the bearing communication hole 125*b* may have a less cross-sectional area than the bearing inlet groove 125*a* and may be formed to be inclined toward the inner circumferential surface of the body 121. The gas groove 125*c* may be formed in the inner circumferential surface of the body 121 in an annular shape with a predetermined depth and an axial length. Alternatively, the gas groove 125*c* may be formed in the outer circumferential surface of the cylinder 140 which is in contact with the inner circumferential surface of the body 121 or may be formed in both the inner circumferential surface of the body 121 and the outer circumferential surface of the cylinder 140.

In addition, a gas inlet 142 corresponding to the gas groove 125*c* may be formed in the outer circumferential surface of the cylinder 140. The gas inlet 142 forms a nozzle part in the gas bearing.

Meanwhile, the frame 120 and the cylinder 140 may be formed of aluminum or an aluminum alloy.

The cylinder 140 may be formed in a cylindrical shape and has both ends which are open, the piston 150 may be inserted through the rear end of the cylinder, and the front end of the cylinder may be closed through a discharge valve assembly 170. The compression space 103 surrounded by the cylinder 140, the front end (the head 151) of the piston 150 and the discharge valve assembly 170 may be formed. The volume of the compression space 103 increases when the piston 150 moves backward and decreases when the piston 150 moves forward. That is, the refrigerant flowing into the compression space 103 may be compressed while the piston 150 moves forward and may be discharged through the discharge valve assembly 170.

The front end of the cylinder 140 may be bent outward to form a flange 141. The flange 141 of the cylinder 140 may be coupled to the frame 120. For example, a flange groove corresponding to the flange 141 of the cylinder 140 may be formed in the front end of the frame 120, and the flange 141 of the cylinder 140 may be inserted into the flange groove to be coupled through a mechanical coupling member.

Meanwhile, a gas bearing unit capable of lubricating gas between the cylinder 140 and the piston 150 by supplying discharge gas to a gap between the outer circumferential surface of the piston 150 and the outer circumferential surface of the cylinder 140 may be provided. The discharge gas between the cylinder 140 and the piston 150 may provide floating force to the piston 150 to reduce friction of the piston 150 against the cylinder 140.

For example, in the cylinder 140, the gas inlet 142 communicating with the gas groove 125*c* formed in the inner circumferential surface of the body 121 and passing through the cylinder 140 in the radial direction to guide the compressed refrigerant flowing into the gas groove 125*c* between the inner circumferential surface of the cylinder 140 and the outer circumferential surface of the piston 150 may be formed. Alternatively, in consideration of convenience of machining, the gas groove 125*c* may be formed in the outer circumferential surface of the cylinder 140.

The entrance of the gas inlet 142 is relatively wide, and the exit of the gas inlet may be formed as a fine hole to function as a nozzle. A filter (not shown) for blocking inflow of foreign materials may be further provided at the entrance of the gas inlet 142. The filter may be a mesh filter made of metal or may be formed by winding a member such as a fine thread.

A plurality of gas inlets 142 may be independently formed or the entrance thereof may be formed of an annular groove, and a plurality of exits may be formed along the annular groove at a certain interval.

In addition, the gas inlet 142 may be formed only at the front side with respect to the axial-direction middle of the cylinder 140, or may also be formed at the rear side in consideration of inclination of the piston 150.

The piston 150 is inserted into the opened rear end of the cylinder 140 to seal the rear side of the compression space 103.

The piston 150 includes a head 151 partitioning the compression space 103 in a disk shape and a cylindrical guide 152 extending rearward from the outer circumferential surface of the head 151. The head 151 is provided to be partially open, and has a hollow inside, a front side partially sealed by the head 151 and a rear side opened to be connected to the muffler unit 160. The head 151 may be provided as a separate member coupled to the guide 152 or the head 151 and the guide 152 may be integrally formed.

The head 151 of the piston 150A has a suction port 154 penetrating therethrough. The suction port 154 is provided to communicate with the suction space 102 inside the piston 150 and the compression space 103. For example, the refrigerant flowing from the receiving space 101 to the suction space 102 inside the piston 150 may be sucked into the compression space 103 between the piston 150 and the cylinder 140 through the suction port 154.

The suction port 154 may extend in the axial direction of the piston 150. Alternatively, the suction port 154 may be formed to be inclined in the axial direction of the piston 150. For example, the suction port 154 may extend to be inclined in a direction away from the central axis toward the rear side of the piston 150.

The suction port 154 may be formed as a circular opening and have a constant inner diameter. Alternatively, the suction port 154 may be formed to have a long hole extending in the radial direction of the head 151 as an opening and an inner diameter increases backward.

A plurality of suction ports 154 may be formed in one or more of the radial direction and the circumferential direction of the head 151.

In addition, a suction valve 155 for selectively opening and closing the suction port 154 may be installed on the head 151 of the piston 150 adjacent to the compression space 103. The suction valve 155 may operate by elastic deformation to open or close the suction port 154. That is, the suction valve 155 may be elastically deformed to open the suction port 154 by the pressure of the refrigerant flowing to the compression space 103 through the suction port 154.

In addition, the piston 150 is connected to a mover 135, and the mover 135 reciprocates in the front-and-rear direction according to movement of the piston 150. The inner stator 134 and the cylinder 140 may be located between the mover 135 and the piston 150. The mover 135 and the piston 150 may be connected to each other by a magnet frame 136 formed by bypassing the cylinder 140 and the inner stator 134 rearward.

The muffler unit 160 is coupled to the rear side of the piston 150 to reduce noise generated while the refrigerant is sucked into the piston 150. The refrigerant sucked through the suction pipe 114 flows into the suction space 102 inside the piston 150 through the muffler unit 160.

The muffler unit 160 includes a suction muffler 161 communicating with the receiving space 101 of the casing 110 and an inner guide 162 connected to the front side of the suction muffler 161 to guide the refrigerant to the suction port 154.

The suction muffler 161 may be located behind the piston 150, and may have a rear opening disposed adjacent to the suction pipe 114 and a front end coupled to the rear side of the piston 150. The suction muffler 161 has a flow path formed in the axial direction to guide the refrigerant in the receiving space 101 to the suction space 102 inside the piston 150.

At this time, in the suction muffler 161, a plurality of noise spaces partitioned by baffles may be formed. The suction muffler 161 may be formed by coupling two or more members with each other. For example, a plurality of noise spaces may be formed by press-fitting a second suction muffler into the first suction muffler. In addition, the suction muffler 161 may be formed of a plastic material in consideration of weight or insulation.

The inner guide 162 may have a pipe shape and may have one side communicating with the noise spaces of the suction muffler 161 and the other side deeply inserted into the piston 150. The inner guide 162 may be formed in a cylindrical shape and may have both ends having the same inner diameter. But, in some cases, the inner diameter of the front end of the discharge side may be greater than the inner diameter of the rear end at the opposite side thereof.

The suction muffler 161 and the inner guide 162 may have various shapes, thereby adjusting the pressure of the refrigerant passing through the muffler unit 160. In addition, the suction muffler 161 and the inner guide 162 may be integrally formed.

The discharge valve assembly 170 may include a discharge valve 171 and a valve spring 172 provided at the front side of the discharge valve 171 to elastically support the discharge valve 171. The discharge valve assembly 170 may selectively discharge the refrigerant compressed in the compression space 103. Here, the compression space 103 may be understood as a space formed between the suction valve 155 and the discharge valve 171.

The discharge valve 171 may be disposed to be supported on the front surface of the cylinder 140, and may be installed to selectively open and close the front opening of the cylinder 140. The discharge valve 171 may operate by elastic deformation to open or close the compression space 103. The discharge valve 171 may be elastically deformed to open the compression space 103 by the pressure of the refrigerant flowing to the discharge space 104 through the compression space 103. For example, in a state in which the discharge valve 171 is supported on the front surface of the cylinder 140, the compression space 103 is maintained in a closed state, and the compressed refrigerant of the compression space 103 may be discharged to the opened space in a state in which the discharge valve 171 is separated from the front surface of the cylinder 140.

The valve spring 172 is provided between the discharge valve 171 and the discharge cover assembly 180 to provide elastic force in the axial direction. The valve spring 172 may be provided as a compression coil spring or may be provided as a leaf spring in consideration of an occupied space or reliability.

When the pressure of the compression space 103 is equal to or greater than discharge pressure, the valve spring 172 is deformed forward to open the discharge valve 171, and the refrigerant is discharged from the compression space 103 to be discharged to the first discharge space **103*a* of the discharge cover assembly 180. In addition, when discharge of the refrigerant is completed, the valve spring 172 provides restoring force to the discharge valve 171 to close the discharge valve 171**.

A process of introducing the refrigerant to the compression space 103 through the suction valve 155 and discharging the refrigerant in the compression space 103 to the discharge space 104 through the discharge valve 171 will now be described.

While the piston 150 linearly reciprocates inside the cylinder 140, when the pressure of the compression space 103 is equal to or less than predetermined suction pressure, the suction valve 155 is opened and the refrigerant is sucked into the compression space 103. On the other hand, when the pressure of the compression space 103 exceeds the predetermined suction pressure, the refrigerant of the compression space 103 is compressed in a state in which the suction valve 155 is closed.

Meanwhile, when the pressure of the compression space 103 is equal to or greater than predetermined discharge pressure, the valve spring 172 is deformed forward to open the discharge valve 171 connected thereto, and the refrigerant is discharged from the compression space 103 to the discharge space 104 of the discharge cover assembly 180. When discharge of the refrigerant is completed, the valve spring 172 provides restoring force to the discharge valve 171, and the discharge valve 171 is closed to seal the front side of the compression space 103.

The discharge cover assembly 180 may be installed in front of the compression space 103 to form the discharge space 104 for receiving the refrigerant discharged from the compression space 103, and may be coupled to the front side of the frame 120 to reduce noise generated while the refrigerant is discharged from the compression space 103. The discharge cover assembly 180 may be coupled to the front side of the flange 122 of the frame 120 while accommodating the discharge valve assembly 170. For example, the discharge cover assembly 180 may be coupled to the flange 122 through a mechanical coupling member.

Between the discharge cover assembly 180 and the frame 120, a gasket 165 for insulation and an O-ring 166 for suppressing leakage of the discharge space 104 may be provided.

The discharge cover assembly 180 may be formed of a thermally conductive material. Accordingly, when high-temperature refrigerant flows into the discharge cover assembly 180, heat of the refrigerant may be transferred to the casing 110 through the discharge cover assembly 180, thereby being radiated to the outside of the compressor.

The discharge cover assembly 180 may include one discharge cover or a plurality of discharge covers sequentially communicating with each other. When the plurality of discharge covers is provided, the discharge space 104 may include a plurality of spaces partitioned by the discharge covers. The plurality of spaces may be disposed in the front-and-rear direction and may communicate with each other.

For example, when the number of discharge covers is 3, the discharge space 104 may include a first discharge space 103*a* formed between a first discharge cover 181 coupled to the front side of the frame 120 and the frame 120, a second discharge space 103*b* communicating with the first discharge space 103*a* and formed between a second discharge cover 182 coupled to the front side of the first discharge cover 181 and the first discharge cover 181, and a third discharge space 103*c* communicating with the second discharge space 103*b* and formed between a third discharge cover 183 coupled to the front side of the second discharge cover 182 and the second discharge cover 182.

The first discharge space 103*a* may selectively communicate with the compression space 103 by the discharge valve 171, the second discharge space 103*b* may communicate with the first discharge space 103*a*, and the third discharge space 103*c* may communicate with the second discharge space 103*b*. Therefore, the refrigerant discharged from the compression space 103 may sequentially pass through the first discharge space 103*a*, the second discharge space 103*b* and the third discharge space 103*c* to reduce discharge noise, and may be discharged to the outside of the casing 110 through the loop pipe 115*a* and the discharge pipe 115 communicating with the third discharge cover 183.

The driving unit 130 may include the outer stator 131 disposed to surround the body 121 of the frame 120 between the shell 111 and the frame 120, the inner stator 134 disposed to the surround the cylinder 140 between the outer stator 131 and the cylinder 140, and the mover 135 disposed between the outer stator 131 and the inner stator 134.

The outer stator 131 may be coupled to the rear side of the flange 122 of the frame 120, and the inner stator 134 may be coupled to the outer circumferential surface of the body 121 of the frame 120. The inner stator 134 may be spaced apart from the inside of the outer stator 131, and the mover 135 may be disposed in a space between the outer stator 131 and the inner stator 134.

The outer stator 131 may be equipped with a winding coil, and the mover 135 may include a permanent magnet. The permanent magnet may be composed of a single magnet having one pole or may be composed of a plurality of magnets having three poles.

The outer stator 131 includes a coil winding body 132 surrounding the cylinder or/and the inner stator in the circumferential direction and a stator core 133 stacked while surrounding the coil winding body 132. The coil winding body 132 may include a hollow cylindrical bobbin 132*a* and a coil 132*b* wound in the circumferential direction of the bobbin 132*a*. The cross section of the coil 132*b* may have a circular or polygonal shape and may have, for example, a hexagonal shape. In the stator core 133, a plurality of lamination sheets may be radially stacked and a plurality of lamination blocks may be stacked in the circumferential direction.

The front side of the outer stator 131 may be supported by the flange 122 of the frame 120, and the rear side thereof may be supported by a stator cover 137. For example, the stator cover 137 may have a hollow disk shape, and may have the outer stator 131 supported on a front surface thereof and a resonance spring 190 supported on a rear surface thereof.

The inner stator 134 may be configured by stacking a plurality of laminations on the outer circumferential surface of the body 121 of the frame 120 in the circumferential direction.

The mover 135 may have one side coupled to and supported by a magnet frame 136. The magnet frame 136 has a substantially cylindrical shape and may be disposed to be inserted into a space between the outer stator 131 and the inner stator 134. In addition, the magnet frame 136 may be coupled to the rear side of the piston 150 and is provided to move along with the piston 150.

For example, the rear end of the magnet frame 136 may be bent inward in the radial direction to form a coupling portion 136*a*, and the coupling portion 136*a* may be coupled to the flange 153 formed at the rear side of the piston 150. The coupling portion 136*a* of the magnet frame 136 and the flange 153 of the piston 150 may be coupled through a mechanical coupling member.

Further, a flange 161*a* formed at the front side of the suction muffler 161 may be interposed between the flange 153 of the piston 150 and the coupling portion 136*a* of the magnet frame 136. Accordingly, the piston 150, the muffler unit 160 and the mover 135 may linearly move in a state of being integrally coupled.

When current is applied to the driving unit 130, a magnetic flux may be formed in the winding coil, and electromagnetic force may be generated by interaction between the magnetic flux formed in the winding coil of the outer stator 131 and the magnetic flux formed by the permanent magnet of the mover 135, thereby moving the mover 135. Simultaneously with axial reciprocation of the mover 135, the piston 150 connected to the magnet frame 136 also reciprocates in the axial direction integrally with the mover 135.

Meanwhile, the driving unit 130 and the compression units 140 and 150 may be supported by the support springs 116 and 117 and the resonance spring 190 in the axial direction.

The resonance spring 118 may amplify vibration realized by reciprocating motion of the mover 135 and the piston 150, thereby effectively compressing the refrigerant. Specifically, the resonance spring 118 may be adjusted by a frequency corresponding to the natural frequency of the piston 150 such that the piston 150 performs resonance motion. In addition, the resonance spring 118 may reduce vibration and noise by enabling stable movement of the piston 150.

The resonance spring 118 may be a coil spring extending in the axial direction. Both ends of the resonance spring 118 may be connected to a vibrating body and a fixing body, respectively. For example, one end of the resonance spring 118 may be connected to the magnet frame 136 and the other end thereof may be connected to a back cover 123. Accordingly, the resonance spring 118 may be elastically deformed between the vibrating body vibrating at one end thereof and the fixing body fixed to the other end thereof.

The natural frequency of the resonance spring 118 may be designed to match the resonance frequencies of the mover 135 and the piston 150 during operation of the compressor 100, thereby amplifying the reciprocating motion of the piston 150. However, since the back cover 123 provided as the fixing body is elastically supported on the casing 110 through the first support spring 116, it may not be strictly fixed.

The resonance spring 118 may include a first resonance spring 118*a* supported on the rear side of a spring supporter 119 and a second resonance spring 118*b* supported on the front side of the spring supporter.

The spring supporter 119 may include a body 119*a* surrounding the suction muffler 161, a coupling portion 119*b* bent axially inward from the front side of the body 119*a*, and a support portion 119*c* bent axially outward from the rear side of the body 119*a*.

The coupling portion 119*b* of the spring supporter 119 may have a front surface supported by the coupling portion 136*a* of the magnet frame 136. The inner surface of the coupling portion 119*b* of the spring supporter 119 may be provided to the surround the outer surface of the suction muffler 161. For example, the coupling portion 119*b* of the spring supporter 119, the coupling portion 136*a* of the magnet frame 136 and the flange 153 of the piston 150 are sequentially disposed and then integrally coupled through a mechanical member. At this time, the flange 161*a* of the suction muffler 161 may be interposed between the flange 153 of the piston 150 and the coupling portion 136*a* of the magnet frame 136 and fixed together, as described above.

The first resonance spring 118*a* may be provided between the front surface of the back cover 123 and the rear surface of the spring supporter 119, and the second resonance spring 118*b* may be provided between the rear surface of the stator cover 137 and the front surface of the spring supporter 119.

In addition, a plurality of first and second resonance springs 118*a* and 118*b* may be provided in the circumferential direction of the central axis. The first resonance spring 118*a* and the second resonance spring 118*b* may be disposed side by side in the axial direction or may be disposed to be unaligned. The first and second springs 118*a* and 118*b* may be disposed at certain intervals in the radial direction of the central axis. For example, three first resonance springs 118*a* and three second resonance springs 118*b* may be provided and disposed at intervals of 120 degrees in the radial direction of the central axis.

Meanwhile, the compressor 100 may include a plurality of sealing members capable of increasing coupling force between the frame 120 and parts around the same.

For example, the plurality of sealing members may include a discharge cover sealing member interposed in a portion, in which the frame 120 and the discharge cover assembly 180 are coupled, and inserted into an installation groove provided in the front end of the frame 120, and a cylinder sealing member provided in a portion, in which the frame 120 and the cylinder 140 are coupled, and inserted into an installation groove provided in the outer surface of the cylinder 140. The cylinder sealing member may prevent the refrigerant of the gas groove 125*c* formed between the inner circumferential surface of the frame 120 and the outer circumferential surface of the cylinder 140 from leaking to the outside and may increase coupling force of the frame 120 and the cylinder 140. The plurality of sealing members is provided in a portion where the frame 120 and the inner stator 134 are coupled and may further include an inner stator sealing member inserted into the installation groove provided in the outer surface of the frame 120. The sealing members may have a ring shape.

Operation of the above-described linear compressor 100 will now be described.

First, when current is applied to the driving unit 130, a magnetic flux may be generated in the outer stator 131 by the current flowing through the coil 132*b*. The magnetic flux generated in the outer stator 131 generates electromagnetic force, and the mover 135 having a permanent magnet may linearly reciprocate by the generated electromagnetic force. Such electromagnetic force may be alternately generated in a direction (the front direction) in which the piston 150 moves toward a top dead center (TDC) during a compression cycle and in a direction (the rear direction) in which the piston 150 moves toward a bottom dead center (BDC) during a suction cycle. That is, the driving unit 130 may generate trust which is force that pushes the mover 135 and the piston 150 in a direction of movement.

The piston 150 which linearly reciprocates inside the cylinder 140 may repeatedly increase and decrease the volume of the compression space 103.

When the piston 150 moves in a direction which increases the volume of the compression space 103 (the rear direction), the pressure of the compression space 103 decreases. Therefore, the suction valve 155 mounted at the front side of the piston 150 may be opened, and the refrigerant remaining in the suction space 102 may be sucked into the compression space 103 along the suction port 154. Such a suction cycle is performed until the piston 150 reaches the BDC by maximizing the volume of the compression space 103.

The piston 150, which has reached the BDC, performs the compression cycle while moving in the direction in which the volume of the compression space 103 decreases (the front direction), by changing a direction of movement. During the compression cycle, the sucked refrigerant is compressed while the pressure of the compression space 103 increases. When the pressure of the compression space 103 reaches set pressure, the discharge valve 171 is pushed out by the pressure of the compression space 103 and is opened from the cylinder 140, and the refrigerant is discharged to the discharge space 104 through the separated space. Such a compression cycle continues while the piston 150 moves to the TDC where the volume of the compression space 103 is minimized.

As the suction cycle and the compression cycle of the piston 150 are repeated, the refrigerant flowing into the receiving space 101 inside the compressor 100 through the suction pipe 114 sequentially passes through the suction guide 116*a*, the suction muffler 161 and the inner guide 162 and flows into the suction space 102 inside the piston 150, and the refrigerant of the suction space 102 flows into the compression space 103 inside the cylinder 140 during the suction cycle of the piston 150. During the compression cycle of the piston 150, the refrigerant of the compression space 103 may be compressed and discharged to the discharge space 104 and then discharged to the outside of the compressor 100 through the loop pipe 115*a* and the discharge pipe 115.

Figure 2:
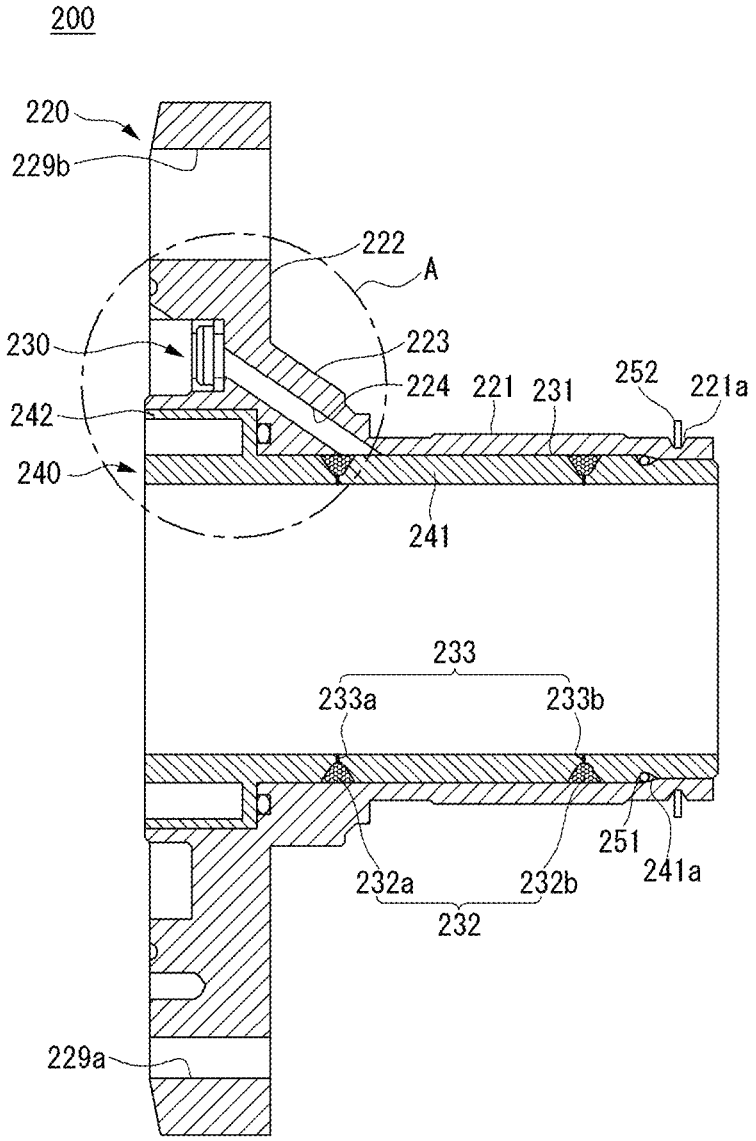
FIG. 2 is a cross-sectional view illustrating the coupling structure of a frame and a cylinder.
Figure 3:
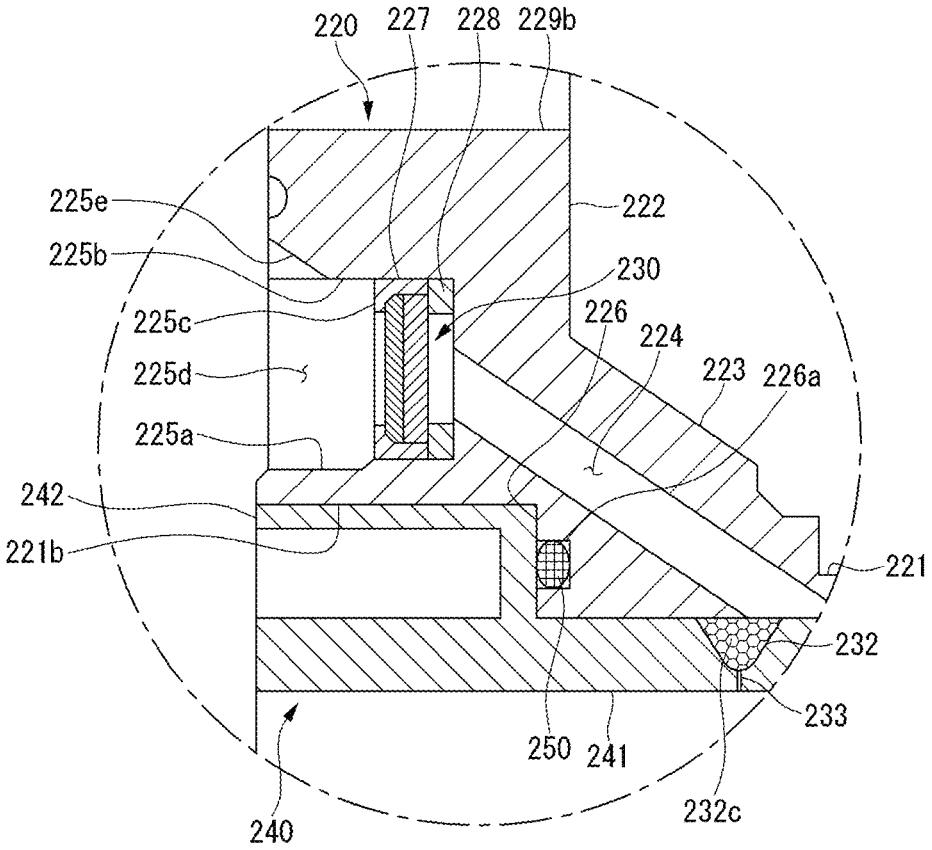
FIG. 3 is an enlarged cross-sectional view of a portion A of FIG. 2.

FIG. 2 is a cross-sectional view illustrating the coupling structure of a frame 220 and a cylinder 240, and FIG. 3 is an enlarged cross-sectional view of a portion A of FIG. 2.

Referring to FIGS. 2 and 3, the cylinder 240 according to the embodiment of the present disclosure may be coupled to the frame 220. For example, the cylinder 240 may be disposed to be inserted into the frame 220.

The frame 220 includes a frame body 221 extending in the axial direction and a frame flange 222 extending axially outward from the frame body 221. In other words, the frame flange 222 may extend to form a first set angle with respect to the outer circumferential surface of the frame body 221. For example, the first set angle may be about 90 degrees.

The frame body 221 may have a cylindrical shape with a central axis in the axial direction and have formed therein a body receiving portion for receiving a cylinder body 241.

A third installation groove 221*a*, into which a third sealing member 252 disposed on the inner stator (see 134 of FIG. 1) is inserted, may be formed in a rear portion of the frame body 221.

The frame flange 222 includes a first wall 225*a* having a ring shape and coupled to a cylinder flange 242, a second wall 225*b* disposed to surround the first wall 225*a* and having a ring shape, and a third wall 225*c* connecting a rear end of the first wall 225*a* and a rear end of the second wall 225*b*. The first wall 225*a* and the second wall 225*b* extend in the axial direction, and the third wall 225*c* may extend in the radial direction.

A frame space 225*d* may be defined by the first to third walls 225*a*, 225*b* and 225*c*. The frame space 225*d* is recessed rearward from the front end of the frame flange 222 to form a portion of the discharge flow path, through which the refrigerant discharged through the discharge valve (see 171 of FIG. 1) flows.

In the inner space of the first wall 225*a*, at least a portion of the cylinder 240, for example, a flange receiving portion 221*b*, into which the cylinder flange 242 is inserted, is included. For example, the inner diameter of the flange receiving portion 221*b* may be equal to or slightly less than the outer diameter of the cylinder flange 242.

When the cylinder 240 is press-fitted into the frame 220, the cylinder flange 242 may interfere with the first wall 225*a* and the cylinder flange 242 may be deformed in this process.

The frame flange 222 further includes a sealing member seating portion 226 extending radially inward from the rear end of the first wall 225*a*. In the sealing member seating portion 226, a first installation groove 226*a*, into which a first sealing member 250 is inserted, is formed. The first installation groove 226*a* may be configured to be recessed rearward from the sealing member seating portion 226.

The frame flange 222 further includes a fastening hole 229*a*, to which a predetermined fastening member is coupled, for fastening of the frame 220 and peripheral components. A plurality of fastening holes 229*a* may be disposed along the outer circumference of the second wall 225*a*.

In the frame flange 222, a terminal insertion portion 229*b* for providing a lead-out path of a terminal portion of the driving unit (see 130 of FIG. 1) is formed. The terminal insertion portion 229*b* is formed such that the frame flange 222 is cut in the front-and-rear direction.

The terminal portion may extend forward from the coil (see 132*b* of FIG. 1) to be inserted into the terminal insertion portion 229*b*. By such a configuration, the terminal portion may be exposed to the outside from the driving unit 130 and the frame 220 and may be connected to a cable.

A plurality of terminal insertion portions 229*b* may be provided. The plurality of terminal insertion portions 229*b* may be disposed along the outer circumference of the second wall 225*b*. Among the plurality of terminal insertion portions 229*b*, there is only one terminal insertion portion 229*b*, into which the terminal portion is inserted. The remaining terminal insertion portions 229*b* may be understood to be provided to prevent deformation of the frame 220.

For example, in the frame flange 222, three terminal insertion portions 229*b* are formed. Among them, the terminal portion may be inserted into one terminal insertion portion 229*b* and may not be inserted into the remaining two terminal insertion portions 229*b*.

A lot of stress may be applied to the frame 220 during fastening with the stator cover (see 137 of FIG. 1) or the discharge cover assembly (see 180 of FIG. 1) or press-fitting of the cylinder 240. If only one terminal insertion portion 229*b* is formed in the frame flange 222, stress may be concentrated on a specific point, thereby deforming the frame flange 222. Accordingly, in the present embodiment, by forming the terminal insertion portions 229*b* at three points of the frame flange 222, that is, uniformly disposing the terminal insertion portions 229*b* based on the central portion of the frame 220 in the circumferential direction, it is possible to prevent stress from being concentrated.

The frame 220 further includes a frame inclined portion 223 extending obliquely from the frame flange 222 toward the frame body 221. The outer surface of the frame inclined portion 223 may extend to form a second set angle with respect to the outer circumferential surface of the frame body 221, that is, in the axial direction. For example, the second set angle may be greater than 0 degrees and may be less than 90 degrees.

In the frame inclined portion 223, a gas hole 224 for guiding the refrigerant discharged from the discharge valve (see 171 of FIG. 1) to the gas inlet 232 of the cylinder 240 is formed. The gas hole 224 may be formed to penetrate through the inside of the frame inclined portion 223.

Specifically, the gas hole 224 may extend from the frame flange 222, and extend to the frame body 221 through the frame inclined portion 223.

Since the gas hole 224 is formed in a portion of the frame 220 having a slightly large thickness, including the frame flange 222, the frame inclined portion 223 and the frame body 221, it is possible to prevent the strength of the frame 220 from decreasing by formation of the gas hole 224.

The extension direction of the gas hole 224 may correspond to the extension direction of the frame inclined portion 223 and form a second set angle with respect to the inner circumferential surface of the frame body 221, that is, in the axial direction.

At the entrance of the gas hole 224, a discharge filter 230 for filtering foreign materials out of the refrigerant to be introduced into the gas hole 224 may be disposed. The discharge filter 230 may be installed on the third wall 225*c*.

Specifically, the discharge filter 230 may be in a filter groove 227 formed in the frame flange 222 the filter groove 227 may be configured to be recessed rearward from the third wall 225*c* and may have a shape corresponding to the shape of the discharge filter 230.

In other words, the entrance of the gas hole 224 may be connected to the filter groove 227, and the gas hole 224 may extend from the filter groove 227 to the inner circumferential surface of the frame body 221 through the frame flange 222 and the frame inclined portion 223. Accordingly, the exit of the gas hole 224 may communicate with the inner circumferential surface of the frame body 221.

In addition, in the frame flange 222, a guide groove 225*e* for facilitating machining of the gas hole 224 may be formed. The guide groove 225*e* may be formed such that at least a portion of the second wall 225*b* is recessed and may be located at an edge of the filter groove 227.

In the process of machining the gas hole 224, a machining tool may be drilled from the filter groove 227 toward the frame inclined portion 223. At this time, the machining tool may interfere with the second wall 225*b*, thereby making drilling difficult. Accordingly, in the present embodiment, a guide groove 225*e* may be formed in the second wall 225*b* and the machining tool may be located in the guide groove 225*e*, thereby facilitating machining of the gas hole 224.

The linear compressor 10 further includes a filter sealing member 228 installed at the rear side of the discharge filter 230, that is, the exit side. The filter sealing member 228 may have a substantially ring shape. Specifically, the filter sealing member 228 may be placed in the filter groove 227, and the discharge filter 230 may be press-fitted into the filter groove 227 while pressing the filter groove 227.

Meanwhile, a plurality of frame inclined portions 223 may be provided along the circumference of the frame body 221. Among the plurality of frame inclined portions 223, there is only one frame inclined portion 223 in which the gas hole 224 is formed. The remaining frame inclined portion 223 may be understood to be provided to prevent deformation of the frame 220.

A lot of stress may be applied to the frame 220 during fastening with the stator cover 149 or the discharge cover assembly 160 or press-fitting of the cylinder 240. If only one frame inclined portion 223 is formed in the frame 220, stress may be concentrated on a specific point, thereby deforming the frame 220. Accordingly, in the present embodiment, by forming the frame inclined portions 223 at three points outside the frame body 221, that is, uniformly disposing the frame inclined portions 223 based on the central portion of the frame 220 in the circumferential direction, it is possible to prevent stress from being concentrated.

The cylinder 240 is coupled to the inside of the frame 220. For example, the cylinder 240 may be coupled to the frame 220 by a press-fitting process.

The cylinder 240 includes a cylinder body 241 extending in the axial direction and the cylinder flange 242 provided outside the front portion of the cylinder body 241. The cylinder body 241 has a cylindrical shape with a central axis in the axial direction, and is inserted into the frame body 221. Accordingly, the outer circumferential surface of the cylinder body 241 may be positioned to face the inner circumferential surface of the frame body 221.

In the cylinder body 241, the gas inlet 232, through which gaseous refrigerant flowing through the gas hole 224 flows, is formed.

The linear compressor 200 further includes a gas pocket 231 formed between the inner circumferential surface of the frame 220 and the outer circumferential surface of the cylinder 240 to enable gas having a lubrication function to flow. A bearing gas flow path from the exit of the gas hole 224 to the gas inlet 232 forms at least a portion of the gas pocket 231.

The gas inlet 232 may be disposed at the entrance side of a nozzle 233 to be described below.

Specifically, the gas inlet 232 may be configured to be recessed radially inward from the outer circumferential surface of the cylinder body 241. The gas inlet 232 may be configured to have a circular shape in the circumferential direction along the outer circumferential surface of the cylinder body 241.

A plurality of gas inlets 232 may be provided.

For example, two gas inlets 232 may be provided. Between two gas inlets 232, a first gas inlet 232*a* may be disposed at the front portion of the cylinder body 241, that is, at a position close to the discharge valve (see 171 of FIG. 1), and a second gas inlet 232*b* is disposed at the rear portion of the cylinder body 241, that is, at a position close to the compressor suction side of the refrigerant.

In other words, the first gas inlet 232*a* may be positioned on the front side and the second gas inlet 232*b* may be positioned on the rear side, with respect to the center of the cylinder body 241 in the front-and-rear direction.

A first nozzle 233*a* connected to the first gas inlet 232*a* may be positioned on the front side of the center, and a second nozzle 233*b* connected to the second gas inlet 232*b* may be positioned on the rear side of the center.

Specifically, the first gas inlet 232*a* or the first nozzle 233*a* is formed at a position separated from the front end of the cylinder body 241 by a first distance. The second gas inlet 232*b* or the second nozzle 233*b* is formed at a position separated from the front end of the cylinder body 241 by a second distance. The second distance may be greater than the first distance. A third distance from the front end to the center of the cylinder body 241 may be greater than the first distance and less than the second distance.

In addition, a fourth distance from the center to the first gas inlet 232*a* or the first nozzle 233*a* may be determined to be less than a fifth distance from the center to the second gas inlet 232*b* or the second nozzle 233*b*.

Meanwhile, the first gas inlet 232*a* is formed at a position adjacent to the exit of the gas hole 224. In other words, a distance from the exit of the gas hole 224 to the first gas inlet 232*a* may be less than a distance from the exit to the second gas inlet 232*b*. For example, the exit of the gas hole 224 and the first gas inlet 232*a* may be disposed to partially overlap.

Since the internal pressure of the cylinder 240 is relatively high at a position close to the discharge side of the refrigerant, that is, the inside of the first gas inlet 232*a*, by placing the exit of the gas hole 224 adjacent to the first gas inlet 232*a*, a relatively large amount of refrigerant may flow into the cylinder 240 through the first gas inlet 232*a*. As a result, by enhancing the function of the gas bearing, it is possible to prevent abrasion of the cylinder 240 and the piston 150 during the reciprocating motion of the piston 150.

In the gas inlet 232, a cylinder filter member 232*c* may be installed. The cylinder filter member 232*c* performs a function for preventing foreign materials having a predetermined size or more from flowing into the cylinder 240 and absorbing oil contained in the refrigerant. Here, the predetermined size may be 1 μm.

The cylinder filter member 232*c* includes a thread wound around the gas inlet 232. Specifically, the thread may be made of a polyethylene terephthalate (PET) material and may have a predetermined thickness or diameter.

The thickness or diameter of the thread may be determined as an appropriate value in consideration of the strength of the thread. If the thickness or diameter of the thread is too small, the strength of the thread is too weak and thus may be easily broken. If the thickness or diameter of the thread is two large, when the thread is wound, an air gap in the gas inlet 232 may be too large, thereby reducing the filtering effect of the foreign materials.

The cylinder body 241 includes a nozzle 233 extending radially inward from the gas inlet 232. The nozzle 233 may extend to the inner circumferential surface of the cylinder body 241.

The radial length of the nozzle 233 is less than that of the gas inlet 232, that is, the depth of the gas inlet. The size of the internal space of the nozzle 233 may be less than that of the internal space of the gas inlet 232.

Specifically, the depth and width of the gas inlet 232 and the length of the nozzle 233 may be determined as an appropriate size in consideration of rigidity of the cylinder 240, the amount of the cylinder filter members 232*c* or the magnitude of the pressure drop of the refrigerant passing through the nozzle 233.

For example, if the depth and width of the gas inlet 232 is too large or if the length of the nozzle 233 is too small, rigidity of the cylinder 240 may be weak. On the other hand, if the depth and width of the gas inlet 232 is too small, the amount of cylinder filter members 232*c* which may be installed in the gas inlet 232 may be too small. In addition, when the length of the nozzle 233 is too large, the pressure drop of the refrigerant passing through the nozzle 233 is too large and thus a sufficient function as a gas bearing cannot be performed.

In the present embodiment, a ratio of the length of the nozzle 233 to the length of the gas inlet 232 is in a range from 0.65 to 0.75. Within the range of the ratio, the gas bearing effect may be improved and rigidity of the cylinder 240 may be maintained at a required level.

In addition, the diameter of the entrance of the nozzle 233 may be greater than that of the exit of the nozzle. Based on the flow direction of the refrigerant, the flow cross-sectional area of the nozzle 233 gradually decreases from the entrance to the exit. Here, the entrance may be understood as a portion connected to the gas inlet 232 to enable the refrigerant flow into the nozzle 233, and the exit may be understood as a portion connected to the inner circumferential surface of the cylinder 240 to supply the refrigerant to the outer circumferential surface of the piston 150.

Specifically, if the diameter of the nozzle 233 is too large, the amount of the refrigerant flowing into the nozzle 233 of the high-pressure gaseous refrigerant discharged through the discharge valve 161 is too large, thereby increasing flow rate loss of the compressor. On the other hand, when the diameter of the nozzle 233 is too small, the pressure drop in the nozzle 233 increases, thereby reducing performance of the gas bearing.

Accordingly, in the present embodiment, when the diameter of the entrance of the nozzle 233 is relatively large, it is possible to decrease the pressure drop of the refrigerant flowing into the nozzle 233, and, when the diameter of the exit is relatively small, it is possible to adjust the inflow amount of the gas bearing through the nozzle 233.

For example, in the present embodiment, the ratio of the diameter of the entrance to the diameter of the exit of the nozzle 233 is determined as a value from 4 to 5. Within the range of the ratio, it is possible to improve the gas bearing effect.

The nozzle 233 includes the first nozzle 233*a* extending from the first gas inlet 232*a* to the inner circumferential surface of the cylinder body 241 and the second nozzle 233*b* extending from the second gas inlet 232*b* to the inner circumferential surface of the cylinder body 241.

The refrigerant filtered by the cylinder filter member 232*c* while passing through the first gas inlet 232*a* flows into a space between the inner circumferential surface of the cylinder body 241 and the outer circumferential surface of the piston 150 through the first nozzle 233. The refrigerant filtered by the cylinder filter member 232*c* while passing through the second gas inlet 232*b* flows into a space between the inner circumferential surface of the cylinder body 241 and the outer circumferential surface of the piston 150 through the second nozzle 233*b*. The gaseous refrigerant flowing to the outer circumferential surface side of the piston 150 through the first and second nozzles 233*a* and 233*b* provides floating force to the piston 150 to perform the function of the gas bearing for the piston 150.

Since the first sealing member 250 seals the front space of the gas pocket 231, it is possible to prevent the refrigerant flowing through the gas pocket 231 from leaking to the front side of the frame 220 and the cylinder 240. Since the second sealing member 251 seals the rear space of the gas pocket 231, it is possible to prevent the refrigerant flowing through the gas pocket 231 from leaking to the rear side of the frame 220 and the cylinder 240. Accordingly, the performance of the gas bearing can be improved.

A second installation groove 241*a*, into which a third sealing member 252 disposed on the cylinder body 221 is inserted, may be formed in the rear portion of the cylinder body 241.

In the embodiment of the present disclosure, as described above, a gas bearing unit may be used. The gas bearing unit may supply discharge gas to a space between the outer circumferential surface of the piston 150 and the outer circumferential surface of the cylinder 240, thereby enabling gas lubrication between the cylinder 240 and the piston 150. The discharge gas between the cylinder 240 and the piston 150 may provide floating force to the piston 150, thereby reducing friction of the piston 150 against the cylinder 240.

Hereinafter, a space between the cylinder 240 and the piston 150, that is, a space filled with discharge gas suppled to provide the floating force will be referred to as a sliding part.

Figure 4:
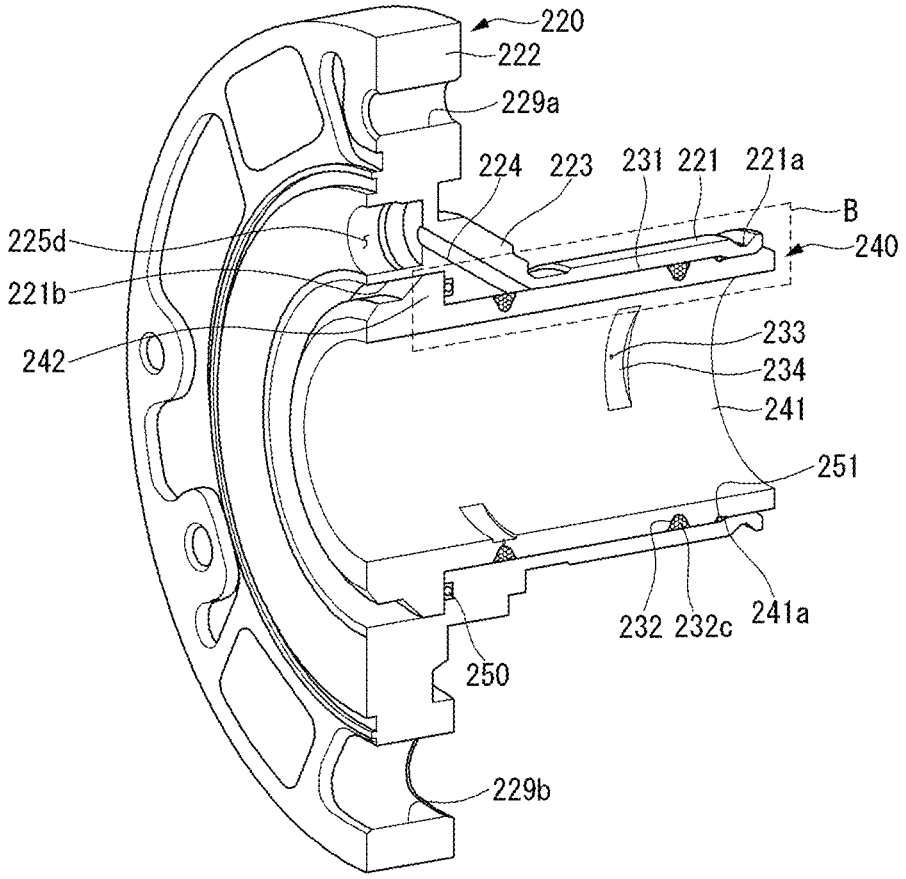
FIG. 4 is a perspective view showing a coupling structure of a cylinder of a compressor according to a first embodiment.
Figure 5:
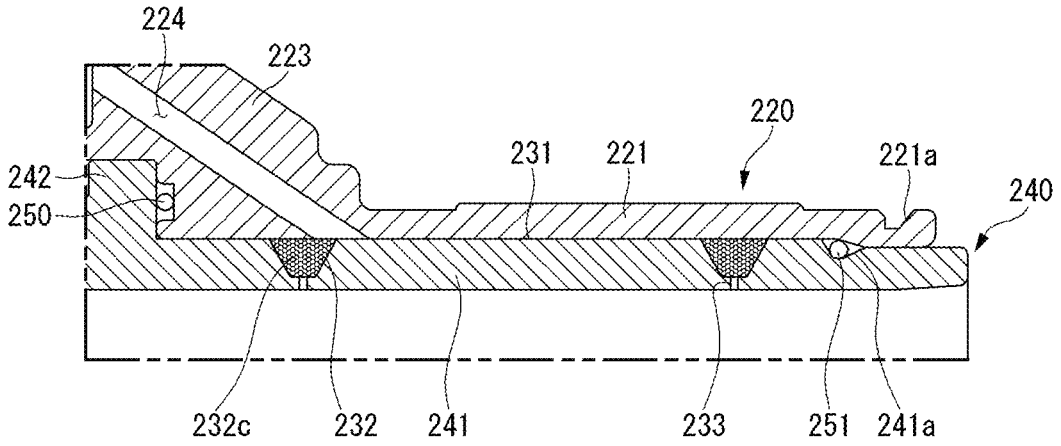
FIG. 5 is an enlarged cross-sectional view showing a portion B of FIG. 4.

FIG. 4 is a perspective view showing a coupling structure of a cylinder and frame of a compressor according to a first embodiment, and FIG. 5 is an enlarged cross-sectional view showing a portion B of FIG. 4.

Referring to FIGS. 4 and 5, in the compressor according to the embodiment of the present disclosure, the gas inlet 232 recessed radially inward from the outer circumferential surface of the cylinder body 241 and extending along the outer circumferential surface in a circular shape is formed.

The gas inlet 232 may communicate with the gas hole 224 to receive lubricating gas through the gas hole 224. For example, at least a portion of the upper portion of the gas inlet 232 may communicate with the gas hole 224.

The cylinder 240 has a gas inlet 232 (232*a* and 232*b*) formed therein, as a passage, through which refrigerant gas received from the gas hole 224 of the frame 220 passes. The gas inlet 232 may have a shape of a groove formed in the outer circumferential surface of the cylinder 240 in the circumferential direction.

The gas inlet 232 includes the first gas inlet 232*a* located at the front portion of the cylinder 240 and the second gas inlet 232*b* located at the rear portion of the cylinder 240.

Hereinafter, the refrigerant gas passing through the gas inlet 232 will be referred to as bearing gas. The bearing gas may perform a bearing function for floating the piston 260 in the cylinder 240.

The first gas inlet 232*a* and the second gas inlet 232*b* may communicate with each other through the gas pocket 231 formed between the cylinder 240 and the frame 220.

In addition, the cylinder 240 may include a nozzle 233 (233*a* and 233*b*) connected to the gas inlet 232 and penetrating through the cylinder body 241 in the radical direction. That is, the nozzle 233 may extend from the gas inlet 232 to the inner circumferential surface of the cylinder body 241.

A plurality of nozzles 233 may be provided in the circumferential direction of the gas inlet 232. The plurality of nozzles 233 may be formed to be spaced apart from each other in the circumferential direction of the gas inlet 232.

That is, a plurality of first nozzles 233*a* may be formed in the first gas inlet 232*a*, and a plurality of second nozzles 233*b* may be formed in the second gas inlet 232*b*.

Specifically, the first gas inlet 232*a* and the first nozzle 233*a* are formed at positions spaced apart from the front end of the cylinder body 241 by a first distance, and the second gas inlet 232*b* and the second nozzle 233*b* are formed at positions spaced apart from the front end of the cylinder body 241 by a second distance greater than the first distance. A third distance from the front end of the cylinder body 241 to the center may be greater than the first distance and less than the second distance.

Meanwhile, the first gas inlet 232*a* is formed at a position adjacent to the exit of the gas hole 224. For example, the exit of the gas hole 224 and the first gas inlet 232*a* may be disposed to partially overlap.

Since the pressure in the internal space of the cylinder 240 is relatively high at a position close to the discharge side of the refrigerant, that is, the inside of the first gas inlet 232*a*, by positioning the exit of the gas hole 224 adjacent to the first gas inlet 232*a*, a relatively large amount of refrigerant may flow into the cylinder 240 through the first gas inlet 232*a*. As a result, it is possible to enhance a gas bearing function and to prevent abrasion of the cylinder 240 and the piston 150 in the reciprocating motion of the piston 150.

In addition, referring to FIG. 3, the cylinder filter member 232*c* may be installed in the gas inlet 232. The cylinder filter member 232*c* performs functions for preventing foreign materials having a predetermined size or more into the cylinder body 241 and absorbing oil contained in the refrigerant. Here, the predetermined size may be 1 μm.

The cylinder filter member 232*c* may be a thread filter 232*c* provided in a shape of a thread wound on the gas inlet 232 30 to 70 times with a constant tension. Specifically, the thread filter 232*c* may be made of polyethylene terephthalate (PET) or polytetrafluoroethylene (PTFE) and may have a predetermined thickness or diameter.

The thread filter 232*c* functions as a filter for blocking fine dirt and oil contained in the bearing gas. In addition, the thread filter 232*c* also functions as a restrictor for reducing the pressure of the bearing gas flowing in a gas bearing system.

A gas receiving groove 234 extending in the circumferential direction and recessed outward in the radial direction may be formed in the inner circumferential surface of the cylinder body 241. The gas receiving groove 234 may extend to form a certain angle with respect to the central axis of the cylinder body 241.

A plurality of gas receiving grooves 234 may be provided in the circumferential direction and the plurality of gas receiving grooves 234 may be spaced apart from each other at the same interval. For example, the gas receiving grooves 234 are concave to extend at an angle between about 15 degrees to 45 degrees in the circumferential direction, and three gas receiving grooves 234 may be disposed at the same interval at an angle of 120 degrees in the circumferential direction.

The gas receiving groove 234 located at the front portion of the cylinder body 241 corresponding to the first gas inlet 232*a* and the gas receiving groove 234 located at the rear portion of the cylinder body 241 corresponding to the second gas inlet 232*b* may be disposed to be unaligned. For example, the gas receiving groove 234 located at the front portion of the cylinder body 241 may be disposed to be unaligned at an angle of 60 degrees.

In addition, the gas receiving groove 234 located at the front portion of the cylinder body 241 corresponding to the first gas inlet 232*a* and the gas receiving groove 234 located at the rear portion of the cylinder body 241 corresponding to the second gas inlet 232*b* may be disposed not to overlap each other in a direction parallel to the axial direction.

The gas receiving groove 234 may be formed at the position facing the gas inlet 232. That is, the gas receiving groove 234 may be disposed adjacent to the gas inlet 232 and may be disposed in the inner surface of the circumference in which the gas inlet 232 is formed.

In other words, the gas receiving groove 234 may be located radially inside the gas inlet 232.

The gas receiving groove 234 may communicate with the gas inlet 232 through the nozzle 233. For example, the nozzle 233 may be formed as a hole penetrating radially from the center of the gas receiving groove 234 to communicate with the gas inlet 232.

The nozzle 233 is usually formed to have a diameter of several tens of micrometers. However, during the repeated use of the compressor, oil permeating into the gas inlet 232 is accumulated, thereby causing frequent clogging. As such, when oil is accumulated in the nozzle 233, surface adhesion is applied and oil does not flow out by pressure applied during the compression cycle of the piston 150.

In the compressor 200 according to the embodiment of the present disclosure, by forming the gas receiving groove 234, it is possible to prevent oil from being accumulated in the nozzle 233. If the exit of the nozzle 233 is directly in contact with or very close to the piston 150, oil of the nozzle 233 is accumulated, thereby increasing the likelihood of clogging.

The gas receiving groove 234 may be formed such that the depth thereof is continuously changed in the circumferential direction of the cylinder body 241. For example, the concave surface (inner surface) of the gas receiving groove 234 may have a curvature greater than that of the inner circumferential surface of the cylinder body 241.

In this case, the nozzle 233 may communicate with the deepest portion of the gas receiving groove 234, and secure a space between the piston 150 and the nozzle 233. As the depth of the gas receiving groove 234 continuously decreases along the circumference of the piston 150 with respect to the nozzle 233, the refrigerant gas supplied through the nozzle 233 may be easily diffused between the piston 150 and the cylinder body 241.

In addition, in the compressor 200 according to the embodiment of the present disclosure, by narrowing the space of the gas pocket 231 functioning as the flow path of the refrigerant gas between the frame 220 and the cylinder 240, it is possible to prevent movement of the permeated oil and collect oil inside the gas pocket 231.

The gas pocket 231 may have a hollow cylindrical shape and may be formed in a space between the inner circumferential surface of the frame body 221 and the outer circumferential surface of the cylinder body 241, and both ends thereof are sealed by sealing members 250 and 251. For example, the front end may be sealed by the first sealing member 250 and the rear end may be sealed by the second sealing member 251.

Usually, in the compressor using the gas bearing unit, the space of the gas pocket 231 is about 150 micrometers. As such, it is possible to facilitate an assembling process by a margin corresponding to assembly tolerance.

In the embodiment of the present disclosure, the space of the gas pocket 231 is in a range of 10 to 30 micrometers. That is, a gap (tolerance) between the inner circumferential surface of the frame body 221 and the outer circumferential surface of the cylinder 240 is in a range of 10 to 30 micrometers.

Figure 6:
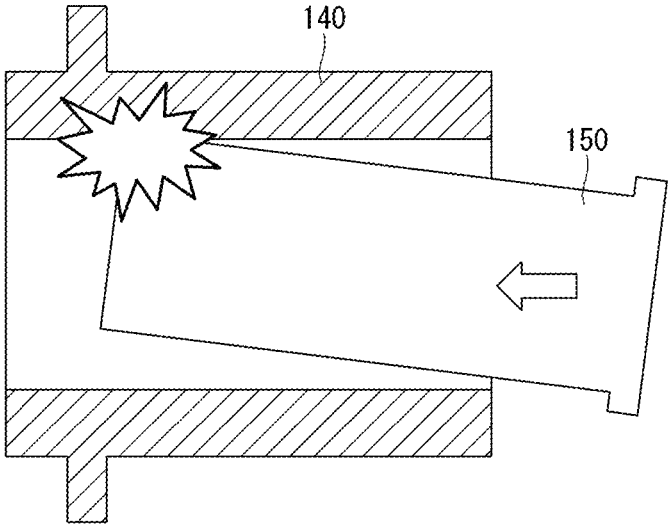
FIG. 6 is a view showing a state in which a piston comes into contact with a cylinder.
Figure 6:
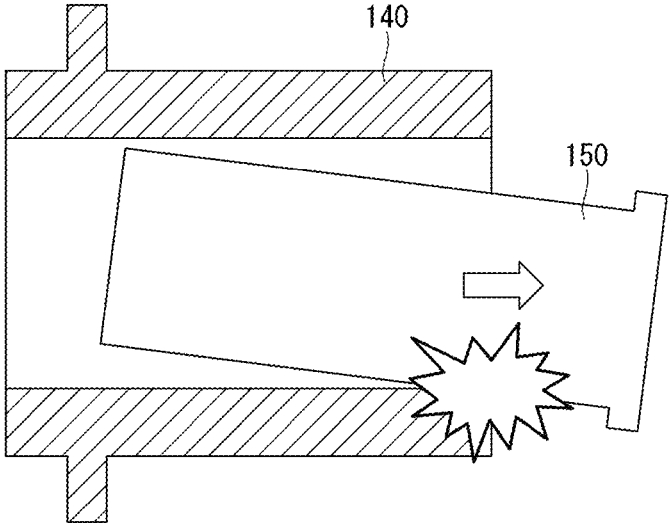

FIG. 6 is a view showing a state in which the piston 150 comes into contact with the cylinder 140.

The piston 150 is directly and mechanically coupled to the magnet frame 136 (see FIG. 1) and thus does not have mobility when moving in the front-and-rear direction. Accordingly, if an error occurs in alignment of the piston 150 or momentum occurs due to external force during operation, a contact occurs between the piston 150 and the cylinder 140.

Referring to (a) of FIG. 6, during the compression cycle of the piston 150, when force to push the front portion of the piston 150 upward is generated, the front upper portion of the piston 150 is brought into contact with the front upper portion of the inner wall of the cylinder 140.

Referring to (b) of FIG. 6, during the suction cycle of the piston 150, when force to push the rear portion of the piston 150 downward is generated, the rear lower portion of the piston 150 is brought into contact with the rear lower portion of the inner wall of the cylinder 140.

As such, when contact between the piston 150 and the cylinder 140 frequently occurs, particles are generated by scratches generated by friction, and irregular cracks occur in the sliding part, thereby decreasing compression reliability.

In order to prevent contact between the piston 150 and the cylinder 140, it is desirable to increase the magnitude of the floating force applied to the piston 150 in the sliding part and to apply the floating force to the large area of the piston 150.

Figure 7:
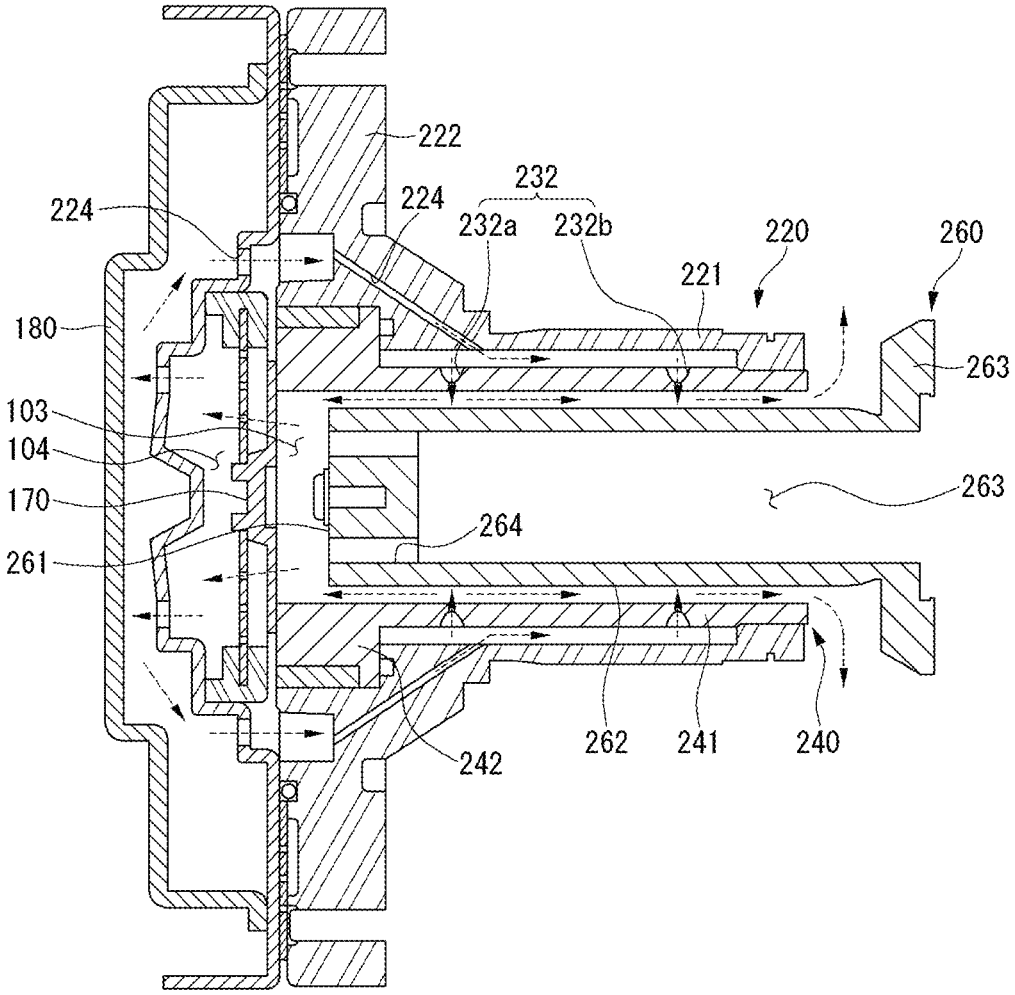
FIG. 7 is a cross-sectional view showing a state in which a piston floats in a gas bearing system.

FIG. 7 is a cross-sectional view showing a state in which a piston floats in a gas bearing system.

Some of the refrigerant gas compressed through reciprocating motion of the piston 260 is introduced through the gas hole 224 formed in the frame 220 and then is sprayed to the sliding part formed inside the cylinder 240 through the plurality of first gas inlets 232*a* formed in the front portion of the cylinder 240 in the circumferential direction and the plurality of the second gas inlets 232*b* formed in the rear portion of cylinder 240 in the circumferential direction. At this time, the piston 260 linearly reciprocates in a state of floating inside the cylinder 240 by the floating force of the bearing gas sprayed from the gas inlet 232.

The bearing gas sprayed to the sling part moves forward and backward along the outer circumferential surface of the piston 260, and the bearing gas moved forward is compressed in the compression space 103 along with the refrigerant of the suction space 102 sprayed through a suction port 264. The bearing gas compressed in the compression space 103 is discharged to the discharge space 104 through the discharge valve assembly 170. Some of the bearing gas of the discharge space 104 is discharged to the outside through a discharge pipe 115 (see FIG. 1) connected to the front side of the casing 110, and some thereof is introduced into the gas hole 224 formed in the frame 220 to function as a bearing medium for the gas bearing.

The bearing gas sprayed to the sliding part and moved backward along the outer circumferential surface of the piston 260 is filled in the receiving space 101 inside the casing 110.

Figure 8:
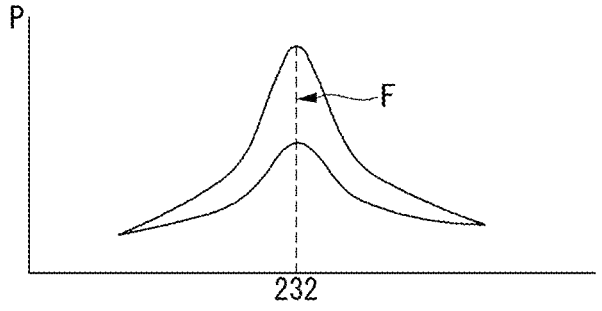
FIG. 8 is a graph showing a gas inlet of FIG. 7 and floating force of a piston around the gas inlet.

FIG. 8 is a graph showing a gas inlet of FIG. 7 and floating force of a piston around the gas inlet.

FIG. 8 is a graph showing the pressure P of the bearing gas at the exit of the gas inlet 232 and at places away from the exit of the gas inlet 232.

Specifically, the graph a shows the pressure P of the bearing gas located at the upper side of the central axis of the piston 260, and the graph b shows the pressure P of the bearing gas located at the lower side of the central axis of the piston.

The pressure P of the bearing gas sprayed in the vicinity of the exit of the gas inlet 232 is high to provide sufficient floating force F to the piston 260 (Here, since the unit area of the outer circumferential surface of the piston 260 is the same, the pressure P and the force F are used without distinction). However, it can be seen that the pressure P rapidly decreases as moving away from the exit of the gas inlet 232. For this reason, since the floating force F applied to the piston 260 is not uniform, eccentricity or inclination of the piston 260 may be caused.

Figure 9:
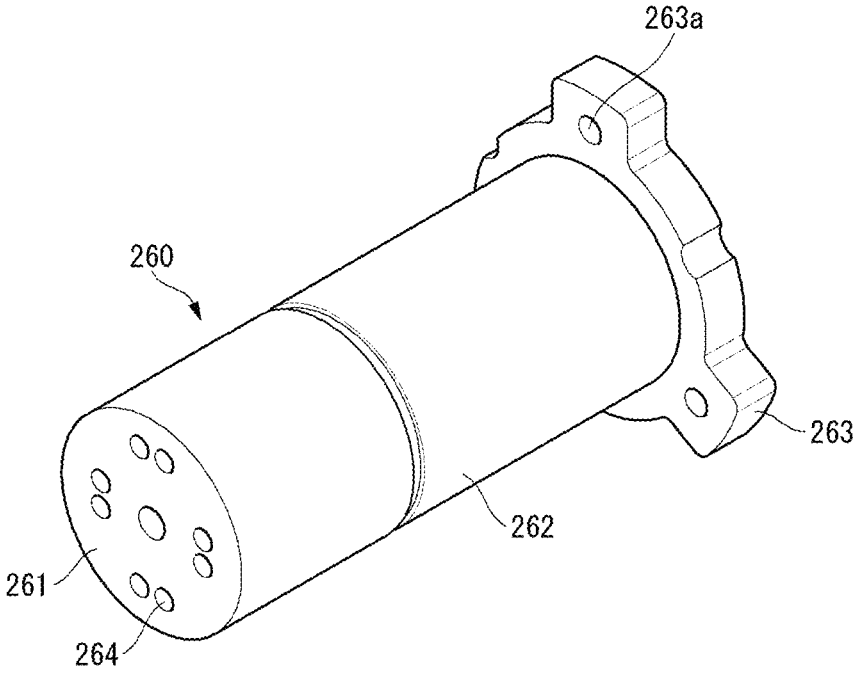
FIG. 9 is a perspective view showing the structure of a general piston.

FIG. 9 is a perspective view showing the structure of a general piston 260.

Referring to FIG. 9, the piston 260 includes a head 261 positioned at a front side thereof to partition a compression space 103 (see FIG. 1) and a suction space 102, a cylindrical guide 262 extending rearward from the outer circumferential surface of the header 261, and a flange 263 extending radially outward from the rear portion of the guide 262 to fix the piston 260 to the structure of the compressor.

The head 261 of the piston 260 may have suction ports 264 penetrating therethrough. The suction ports 264 are provided to communicating with a suction space 102 (see FIG. 1) inside the piston 260 and the compression space 103.

A coupling hole 263*a*, through which a fastening member passes, is formed in the flange 263 of the piston 260, for coupling with a magnet frame 136 (see FIG. 1) and coupling with the coupling portion 136*a* (see FIG. 1) of the magnet frame 136 through the fastening member.

Figure 10:
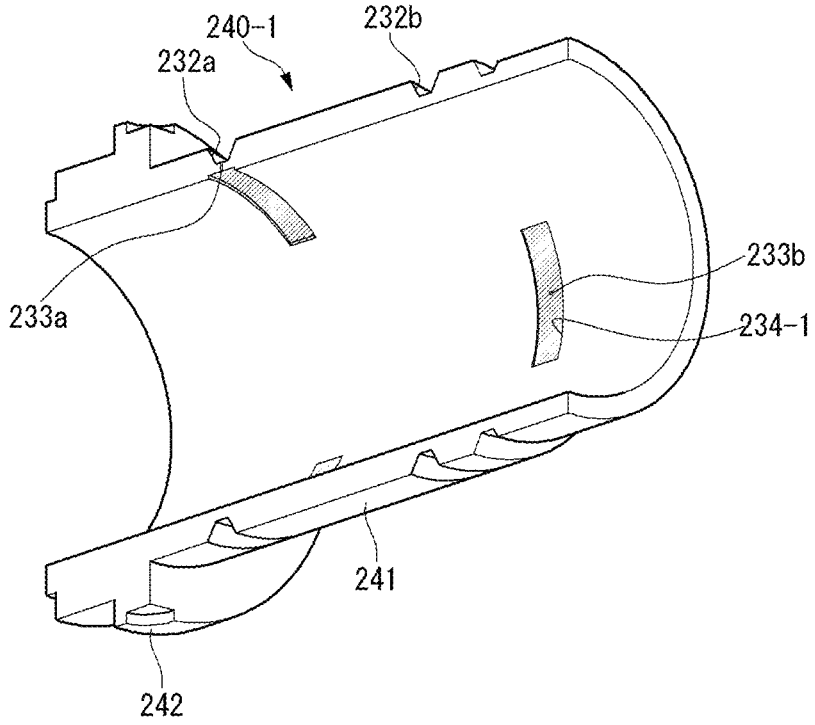
FIG. 10 is a perspective view showing a driving-shaft direction cross section of a cylinder according to a first embodiment.
Figure 11:
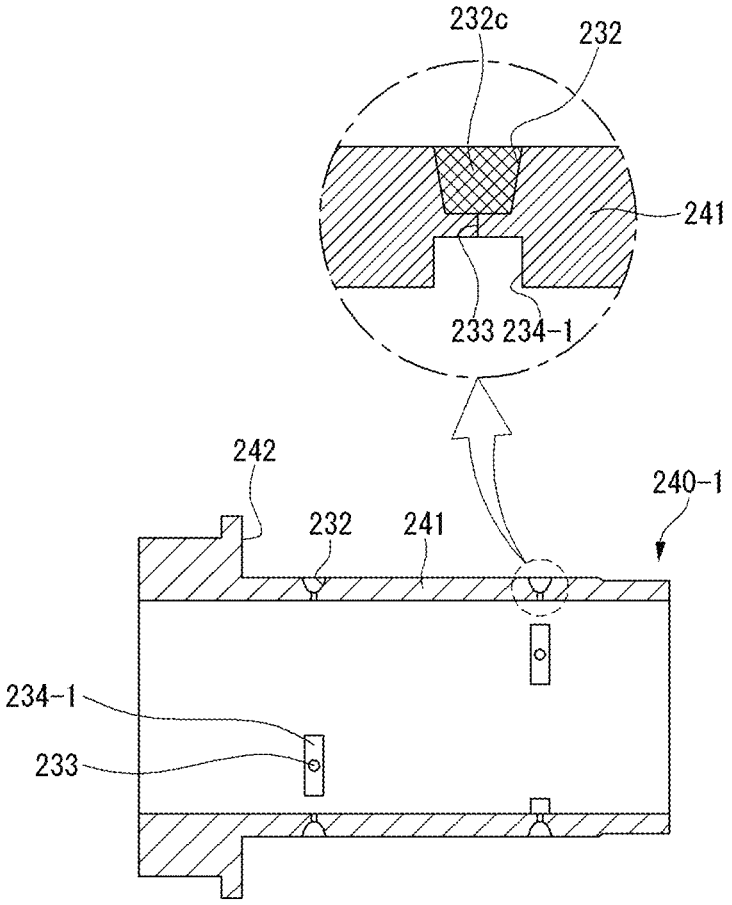
FIG. 11 is a cross-sectional view of a cylinder according to a first embodiment in a driving-shaft direction.

FIG. 10 is a perspective view showing a driving-shaft direction cross section of a cylinder 240-1 according to a first embodiment, and FIG. 11 is a cross-sectional view of a cylinder 240-1 according to a first embodiment in a driving-shaft direction.

The cylinder 240-1 is coupled to the inside of the frame 120 (see FIG. 1). For example, the cylinder 240-1 may be coupled to the frame 120 by a press-fitting process.

The cylinder 240-1 includes the cylinder body 241 extending in the axial direction and the cylinder flange 242 provided outside the front portion of the cylinder body 241. The cylinder body 241 has a cylindrical shape with a central axis in the driving-shaft direction, and is inserted into the body 121 of the frame 120. Accordingly, the outer circumferential surface of the cylinder body 241 may be located to face the inner circumferential surface of the body 121 of the frame 120.

In the cylinder body 241, the gas inlet 232, through which the gaseous refrigerant flows through the gas hole 224 penetrating through the frame 120 and the nozzle 233 communicating with the gas inlet 232 and the sliding part are formed. For the gas inlet 232 and the nozzle 233, refer to the description of FIGS. 2 and 3.

A gas receiving groove 234-1 extending in the circumferential direction at a predetermined angle may be formed in the inner circumferential surface of the cylinder body 241. A plurality of gas receiving grooves 234-1 may be provided in the circumferential direction of the cylinder body 241, and the plurality of gas receiving grooves 234-1 may be disposed to be spaced apart from each other at the same interval in the circumferential direction.

For example, the gas receiving grooves 234-1 are concave to extend at an angle between about 15 degrees to 45 degrees in the circumferential direction and three gas receiving grooves 234-1 may be disposed at the same interval at an angle of 120 degrees in the circumferential direction. However, the extension angle of the gas receiving grooves 234-1 and the number of gas receiving grooves 234-1 are examples and may be changed.

The gas receiving groove 234-1 located at the front portion of the cylinder body 241 corresponding to the first gas inlet 232*a* and the gas receiving groove 234-1 located at the rear portion of the cylinder body 241 corresponding to the second gas inlet 232*b* may be disposed to be unaligned.

For example, the gas receiving groove 234-1 located at the front portion of the cylinder body 241 and the gas receiving groove 234-1 located at the rear portion of the cylinder body 241 may be disposed to be unaligned at an angle of 60 degrees.

In addition, the gas receiving groove 234 located at the front portion of the cylinder body 241-1 corresponding to the first gas inlet 232*a* and the gas receiving groove 234-1 located at the rear portion of the cylinder body 241 corresponding to the second gas inlet 232*b* may be disposed not to overlap each other in a direction parallel to the axial direction.

The gas receiving groove 234-1 may be formed at the position facing the gas inlet 232. That is, the gas receiving groove 234-1 may be disposed adjacent to the gas inlet 232 and may be disposed in the inner surface of the circumference in which the gas inlet 232 is formed.

In other words, the gas receiving groove 234-1 may be located radially inside the gas inlet 232.

The gas receiving groove 234-1 may communicate with the gas inlet 232 through the nozzle 233. For example, the nozzle 233 may be formed as a hole penetrating radially from the center of the gas receiving groove 234 to communicate with the gas inlet 232.

The nozzle 233 is usually formed to have a diameter of several tens of micrometers. However, during the repeated use of the compressor, oil permeating into the gas inlet 232 is accumulated, thereby causing frequent clogging. As such, when oil is accumulated in the nozzle 233, surface adhesion is applied and oil does not flow out by pressure applied during the compression cycle of the piston 150.

In the compressor 200 according to the embodiment of the present disclosure, by forming the gas receiving groove 234-1, it is possible to prevent oil from being accumulated in the nozzle 233. If the exit of the nozzle 233 is directly in contact with or very close to the piston 150, oil of the nozzle 233 is accumulated, thereby increasing the likelihood of clogging.

The gas receiving groove 234-1 may be formed such that the depth thereof is continuously changed in the circumferential direction of the cylinder body 241. For example, the concave surface (inner surface) of the gas receiving groove 234-1 may have a curvature greater than that of the inner circumferential surface of the cylinder body 241.

In this case, the nozzle 233 may communicate with the deepest portion of the gas receiving groove 234-1, and secure a space between the piston 150 and the nozzle 233. As the depth of the gas receiving groove 234-1 continuously decreases along the circumference of the piston 150, the refrigerant gas supplied through the nozzle 233 may be easily diffused between the piston 150 and the cylinder body 141.

In addition, the gas inlet 232 and the nozzle 233 may function as a restrictor for reducing the flow rate in order to generate flotation force capable of floating the piston 260 in the cylinder 240-1. In order to perform the restrictor function, the gas inlet 232 may be filled with the cylinder filter member 232*c* including a thread filter or a porous material, and the nozzle 233 may function as an orifice.

In addition, the gas receiving groove 234-1 may be provided in a shape of a pocket or a groove for generating floating force using high-pressure gas generated from the restrictor. The floating force and an area, to which the floating force is applied, may increase according to the shape and arrangement of the gas receiving groove 234-1.

At this time, the gas inlet 232, the nozzle 233 and the gas receiving groove 234-1 may be defined as a gas inflow passage for guiding gas bearing refrigerant to the internal space of the cylinder 240-1.

Figure 12:
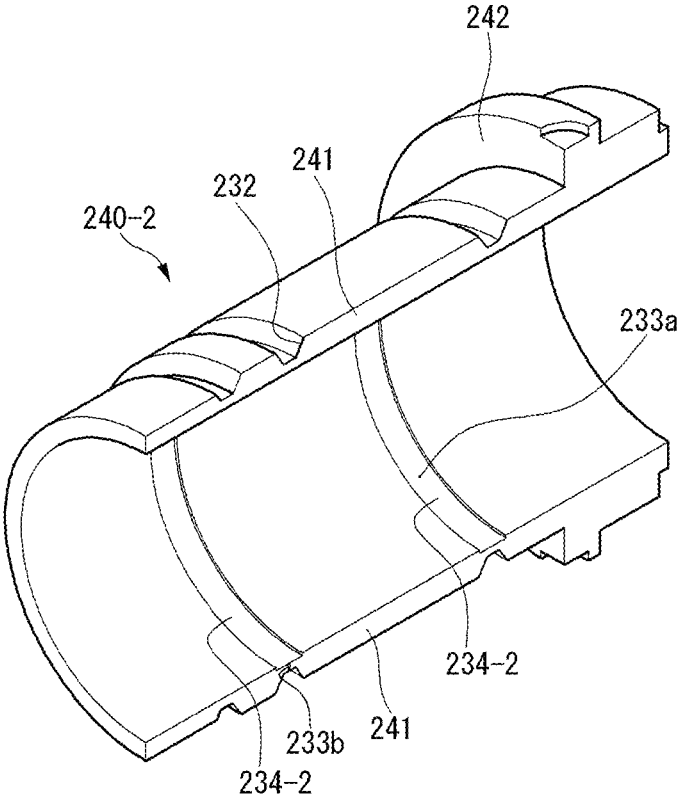
FIG. 12 is a perspective view showing a driving-shaft direction cross section of a cylinder according to a second embodiment.
Figure 13:
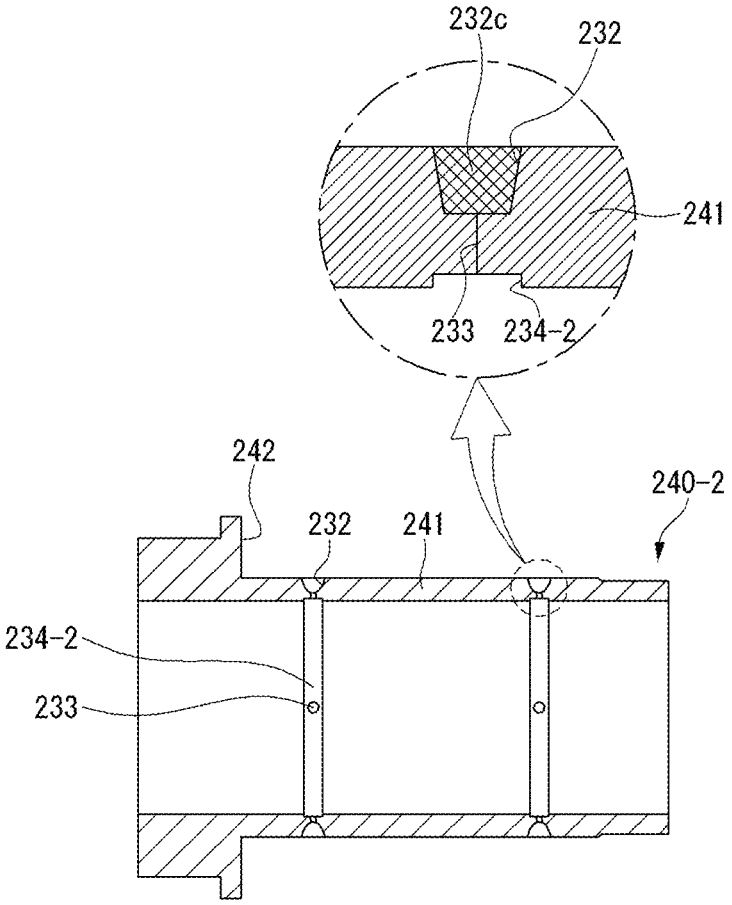
FIG. 13 is a cross-sectional view of a cylinder according to a second embodiment in a driving-shaft direction.

FIG. 12 is a perspective view showing a driving-shaft direction cross section of a cylinder 240-2 according to a second embodiment, and FIG. 13 is a cross-sectional view of a cylinder 240-2 according to a second embodiment in a driving-shaft direction.

Referring to FIGS. 12 and 13, a gas receiving groove 234-2 formed in the inner circumferential surface of the cylinder 240-2 may be formed to be recessed in the radial direction, extend in the circumferential direction of the cylinder 240-2, and have a circular band shape. The gas receiving groove 234-2 may extend in the circumferential direction such that the floating force of the bearing gas is uniformly applied in the circumferential direction.

The gas receiving groove 234-2 according to the second embodiment may be located at each of the front and rear portions of the cylinder 240-2.

The depth of the gas receiving groove 234-2 according to the second embodiment may be smaller than that of the gas receiving groove 234-1 according to the first embodiment shown in FIGS. 10 and 11. This is associated with the volume of the gas receiving groove 234-2, and the depth of the gas receiving groove 234-2 according to the second embodiment may decrease as the width of the gas receiving groove increases. In addition, by decreasing the depth of the gas receiving groove 234-2, it is possible to further improve durability of the cylinder 240-2.

Figure 14:
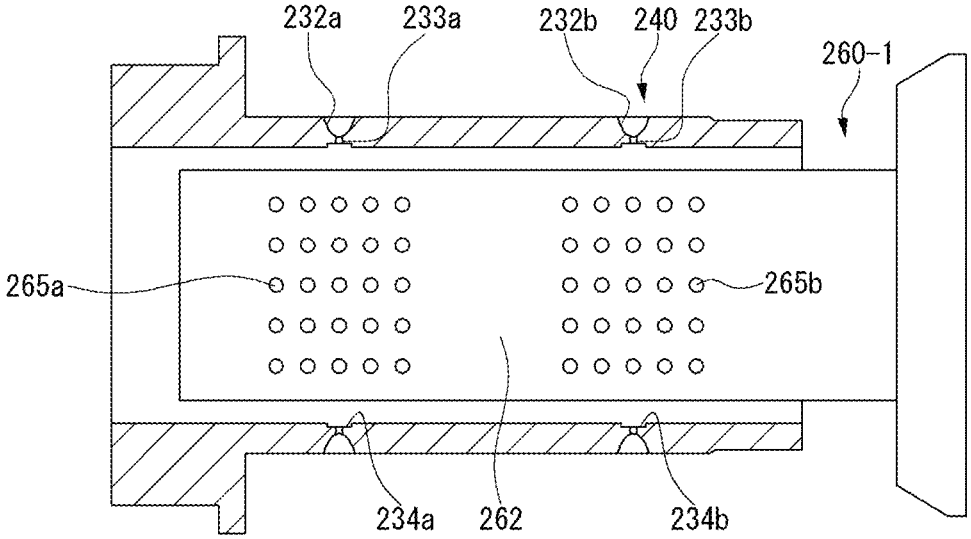
FIG. 14 is a partial cross-sectional view showing a state in which a piston according to a first embodiment is coupled to the cylinder.

FIG. 14 is a partial cross-sectional view showing a state in which a piston 260-1 according to a first embodiment is coupled to the cylinder 240.

Referring to FIG. 14, fine irregularities may be formed in the outer circumferential surface of the piston 260-1 according to the first embodiment. The fine irregularities may include fine grooves.

Specifically, the piston 260-1 may include fine grooves 265 or fine pores formed in the outer circumferential surface thereof. Specifically, a plurality of fine grooves 265 or the fine pores may be formed in the circumferential direction and the longitudinal direction of the guide 262.

For example, the fine groove 265 may include a first fine groove 265*a* provided at a position corresponding to the first nozzle 233*a* located at the front portion of the cylinder 240-2 and a second fine groove 265*b* provided at a position corresponding to the second nozzle 233*b* located at the rear portion of the cylinder 240-2.

The first fine groove 265*a* and the second fine groove 265*b* may be formed to be spaced apart from each other in the longitudinal direction of the guide 262.

The fine groove 265 or the fine pores may be arranged in a plurality of rows in the longitudinal direction of the guide 262. For example, a plurality of first fine grooves 265*a* arranged in the front portion of the guide 262 in the circumferential direction may form one row, and a plurality of rows, each of which is formed by the plurality of first fine grooves 265*a*, may be formed side by side in the longitudinal direction of the guide 262.

Similarly, a plurality of second fine grooves 265*b* arranged in the rear portion of the guide 262 in the circumferential direction may form one row, and a plurality of rows, each of which is formed by the plurality of second fine grooves 265*b*, may be formed side by side in the longitudinal direction of the guide 262.

The plurality of fine grooves 265 forming one row may be spaced apart from each other at certain intervals in the circumferential direction of the guide 262, and the plurality of rows may be spaced apart from each other at certain intervals in the longitudinal direction of the guide 262.

In addition, a distance between the rearmost row of the plurality of rows formed by the first fine grooves 265*a* and the foremost row of the plurality of rows formed by the second fine groove 265*b* may be greater than a distance between the plurality of rows formed by the first fine groove 265*a* or a distance between the plurality of rows formed by the second fine groove 265*b*.

At this time, the longitudinal region in which the fine groove 265 or the fine pores are arranged may be determined according to the position of the nozzle 233 and the reciprocating length of the piston 260-2.

For example, when the piston 260-2 is located at the TDC, the rear row of the first fine grooves 265*a* may be disposed at the position of the first nozzle 233*a* and the rear row of the second fine grooves 265*b* may be disposed at the position of the second nozzle 233*b*. When the piston 260-2 is located at the BDC, the front row of the first fine grooves 265*a* may be disposed at the position of the first nozzle 233*a* and the front row of the second fine grooves 265*b* may be disposed at the position of the second nozzle 233*b*.

The fine groove 265 may be provided in the form of a micro dimple.

Specifically, the sizes of the fine groove 265, that is, the diameter and the depth, may be in a range of 10 micrometers to 1 millimeter. Preferably, the sizes of the fine groove 265, that is, the diameter and the depth, may be in a range of 5 micrometers to 1 millimeter.

In addition, a gap between the fine grooves 265 may be equal to or greater than 1 time the diameter. If the distance between the fine grooves 265 is too small, the surface of the piston 260 may crack.

Meanwhile, the fine grooves or the fine pores may be formed using etching or laser processing.

The fine groove 265 or the fine pores according to the first embodiment may be defined as first fine irregularities.

Figure 15:
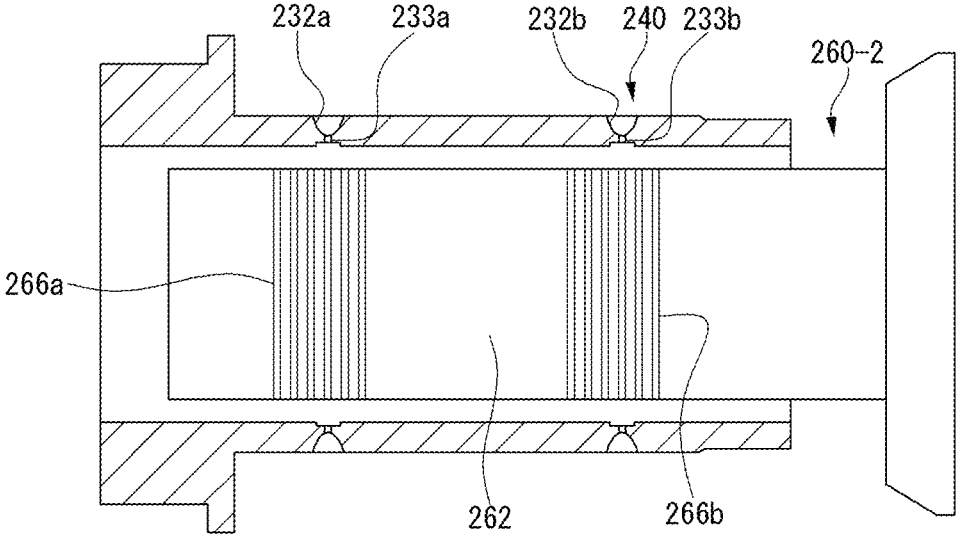
FIG. 15 is a partial cross-sectional view showing a state in which the piston according to a second embodiment is coupled to the cylinder.

FIG. 15 is a partial cross-sectional view showing a state in which the piston 260-2 according to a second embodiment is coupled to the cylinder 240.

Referring to FIG. 15, the piston 260-2 according to the second embodiment may include fine irregularities formed in the outer circumferential surface thereof.

The fine irregularities may include fine grooves 266. Specifically, the fine grooves 266 may extend in the circumferential direction of the guide 262, and a plurality of fine grooves may be formed in the longitudinal direction of the guide 262.

The fine grooves 266 may extend in the circumferential direction of the guide 262 and may have a circular band shape.

For example, the fine groove may include a first fine groove 266*a* provided at a position corresponding to the first nozzle 233*a* located at the front portion of the cylinder 240 and a second fine groove 266*b* provided at a position corresponding to the second nozzle 233*b* located at the rear portion of the cylinder 240.

The fine grooves 266 may be arranged in a plurality of rows in the longitudinal direction of the guide 262. For example, the first fine grooves 266*a* and the second fine grooves 266*b* may be defined as one row formed in the circumferential direction of the guide 262 and a plurality of rows may be arranged side by side in the longitudinal direction of the guide 262.

The plurality of rows may be spaced apart from each other at certain intervals in the longitudinal direction of the guide 262.

In addition, a distance between the rearmost row of the plurality of rows formed by the first fine grooves 266*a* and the foremost row of the plurality of rows formed by the second fine groove 266*b* may be greater than a distance between the first fine groove 266*a* or a distance between the second fine groove 266*b*.

At this time, the longitudinal region in which the fine groove 266 are arranged may be determined according to the position of the nozzle 233 and the reciprocating length of the piston 260-2.

For example, when the piston 260-2 is located at the TDC, the rear row of the first fine grooves 266*a* may be disposed at the position of the first nozzle 233*a*, and the rear row of the second fine grooves 266*b* may be disposed at the position of the second nozzle 233*b*.

When the piston 260-2 is located at the BDC, the front row of the first fine grooves 266*a* may be disposed at the position of the first nozzle 233*a*, and the front row of the second fine grooves 266*b* may be disposed at the position of the second nozzle 233*b*.

The fine grooves 266 may have a width of 100 micrometers to 3 mm and a depth of 1 micrometers to 15 micrometers. In addition, the distance between adjacent fine grooves 266 may be 1 mm or more.

The fine grooves 266 according to the second embodiment may be defined as second fine irregularities.

Figure 16:
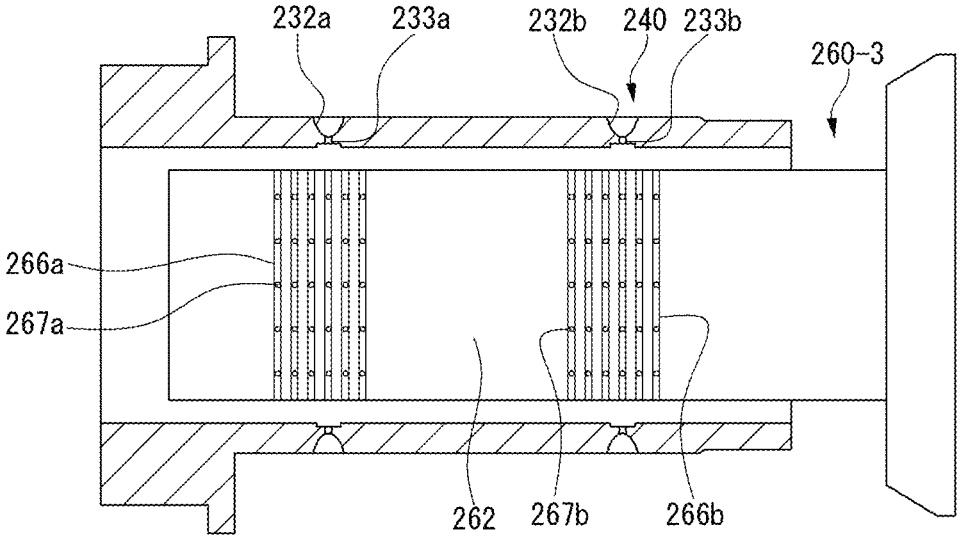
FIG. 16 is a partial cross-sectional view showing a state in which the piston according to a third embodiment is coupled to the cylinder.

FIG. 16 is a partial cross-sectional view showing a state in which the piston 260-3 according to a third embodiment is coupled to the cylinder 240.

Referring to FIG. 16, the piston 260-3 according to the third embodiment may include fine irregularities formed in the outer circumferential surface thereof. The fine irregularities may include first fine irregularities 267 and second fine irregularities 266.

Specifically, the second fine irregularities 266 may extend in the circumferential direction of the guide 262, may be provided in the shape of a groove recessed from the outer circumferential surface of the guide 262, and a plurality of second fine irregularities may be formed in the longitudinal direction of the guide 262.

The second fine irregularities 266 may extend in the circumferential direction of the guide 262 and have a circular band shape.

For example, the second fine irregularities 266 may include (2-1)-th fine irregularities 266*a* provided at a position corresponding to the first nozzle 233*a* located at the front portion of the cylinder 240 and (2-2)-th fine irregularities 266*b* provided at a position corresponding to the second nozzle 233*b* located at the rear portion of the cylinder 240.

The second fine irregularities 266 may be arranged in a plurality of rows in the longitudinal direction of the guide 262. For example, the (2-1)-th fine irregularities 266*a* and the (2-2)-th fine irregularities 266*b* may be defined as one row extending in the circumferential direction of the guide 262, and may be arranged side by side in a plurality of rows in the longitudinal direction of the guide 262.

In addition, the first fine irregularities 267 may be provided in the form of micro dimples or fine grooves. The first fine irregularities 267 may be formed in the bottom surfaces of the second fine irregularities 266.

The first fine irregularities 267 may be recessed from the bottom surfaces of the second fine irregularities 266, and a plurality of first fine irregularities may be formed in the circumferential direction of the second fine irregularities 266.

Figure 17:
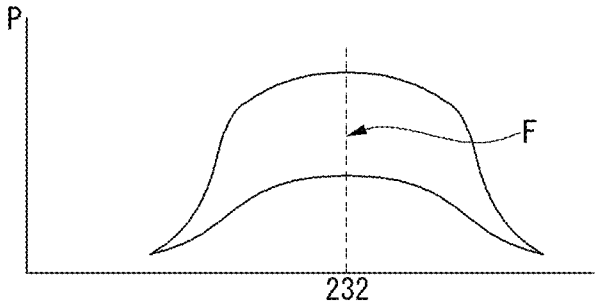
FIG. 17 is a graph showing a gas inlet of FIG. 14 or 15 and floating force of a piston around the gas inlet.

FIG. 17 is a graph showing a gas inlet of FIG. 14 or 15 and floating force of a piston around the gas inlet.

Similarly to FIG. 8, a graph showing the pressure P of the bearing gas at the exit of the gas inlet 232 and at places away from the exit of the gas inlet 232 is shown.

Specifically, the graph a shows the pressure P of the bearing gas located at the upper side of the central axis of the piston 260, and the graph b shows the pressure P of the bearing gas located at the lower side of the central axis of the piston.

As compared to FIG. 8, referring to FIG. 17, it can be seen that the pressure P of the bearing gas sprayed in the vicinity of the exit of the gas inlet 232 is uniformly distributed in the longitudinal direction of the piston 260. By providing uniform floating force F in a predetermined range in the longitudinal direction of the piston 260, it is possible to prevent eccentricity or inclination of the piston 260.

Figure 18:
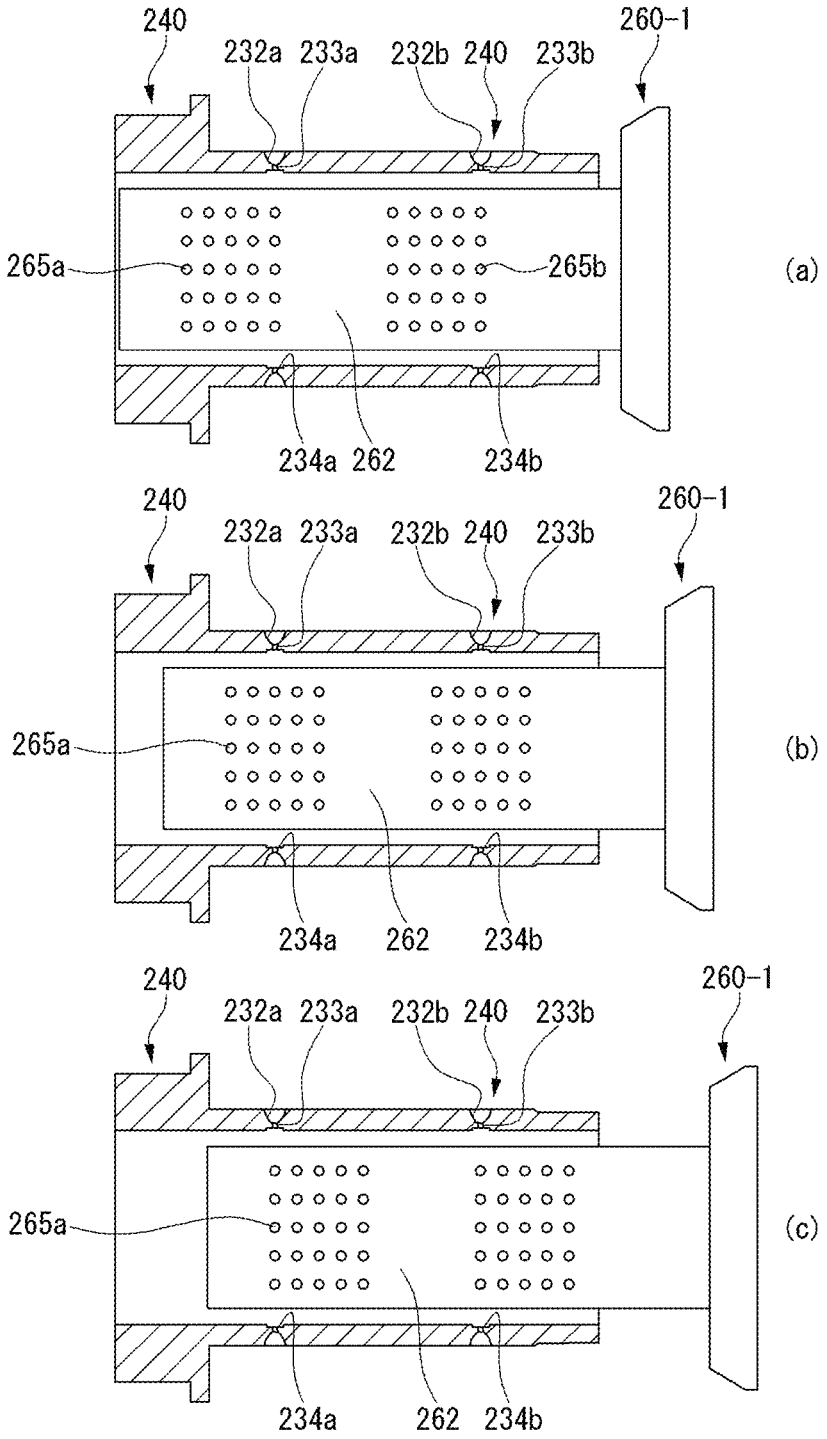
FIG. 18 is a partial cross-sectional view showing a state in which a piston according to a first embodiment moves inside a cylinder.

FIG. 18 is a partial cross-sectional view showing a state in which a piston 260-1 according to a first embodiment moves inside a cylinder 240.

Referring to (a) of FIG. 18, when the piston 260-1 is located at the TDC, at least one row of the fine grooves 265 of the piston 260-1 may be provided to be located at a position overlapping the gas receiving groove 234 of the cylinder 240.

For example, among first fine grooves 265*a* located at the front portion of the piston 260-1 and forming a plurality of rows, the fine grooves located at the rear portion may be located at a position overlapping the first gas receiving groove 234*a* located at the front portion of the cylinder 240, and, among second fine grooves 265*b* located at the rear portion of the piston 260-1 and forming a plurality of rows, the fine grooves located at the rear portion may be located at a position overlapping the second gas receiving groove 234*b* located at the rear portion of the cylinder 240.

Referring to (c) of FIG. 18, when the piston 260-1 is located at the BDC, at least one row of the fine grooves 265 of the piston 260-1 may be located at a position overlapping the gas receiving groove 234 of the cylinder 240.

For example, among the first fine grooves located at the front portion of the piston 260-1 and forming a plurality of rows, the fine grooves located at the front portion may be located at a position overlapping the first gas receiving groove 234*a* located at the front portion of the cylinder 240, and, among the second fine grooves 265*b* located at the rear portion of the piston 260-1 and forming a plurality of rows, the fine grooves located at the front portion may be located at a position overlapping the second gas receiving groove 234*b* located at the rear portion of the cylinder 240.

(b) of FIG. 18 shows a state in which the piston 260-1 moves between the TDC and the BDC. Even at this time, the fine groove 265 is located at a position overlapping the gas receiving groove 234 of the cylinder 240.

Figure 19:
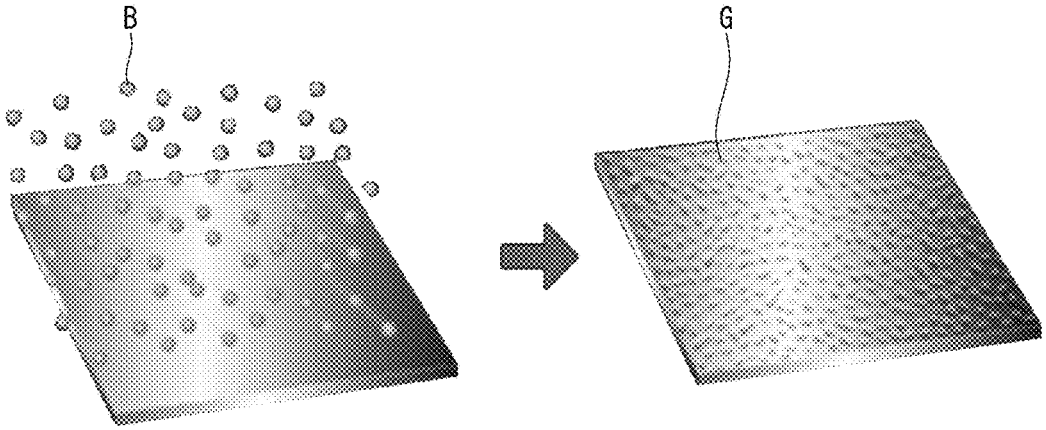
FIG. 19 is a view showing a state in which fine grooves are formed in a metal surface using ultra-fine steel balls.
Figure 20:
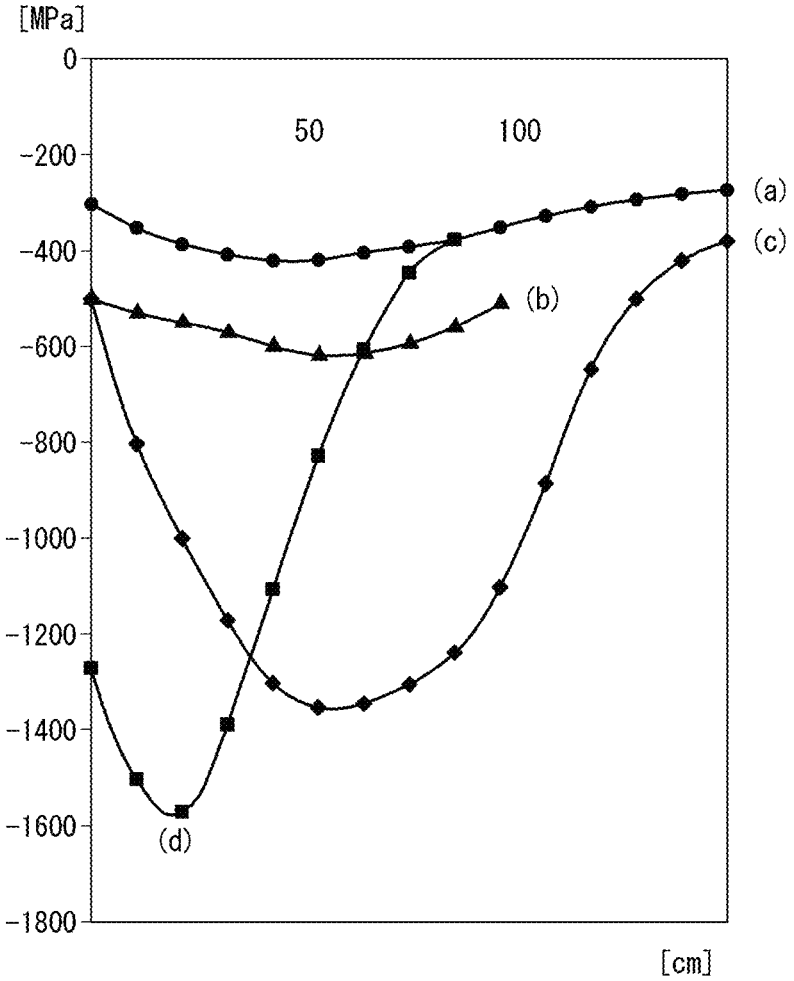
FIG. 20 is a graph showing a decrease in surface residual stress in forging using ultra-fine steel balls.

FIG. 19 is a view showing a state in which fine grooves G are formed in a metal surface using ultra-fine steel balls B and FIG. 20 is a graph showing a decrease in surface residual stress in forging using the ultra-fine steel balls B.

In explaining the forging treatment method using the ultra-fine steel balls (or ultra-fine media), the ultra-fine steel balls B are projected at a high speed toward the surface of a product to be treated, compressive stress is generated at an impact point and a micro thermal reaction occurs. By such reaction, fine fractures of the surface may be efficiently sealed. In addition, the surface of the product to be treated may be compressed to form a condensed surface with improved density. It is possible to overcome brittleness generally occurring when metal is hardened, by using such a forging treatment method.

Specifically, in a conventional shot peening method, iron media having a diameter of 600 to 800 micrometers are sprayed at a speed of 70 to 80 m/s. However, in the ultra-fine forging treatment method, steel balls B having a diameter of 40 to 200 micrometers are sprayed at a speed of 200 m/s. As a result, since faster heating and cooling are repeated, heat treatment and forging effect occur on the surface.

Referring to FIG. 19, the conventional shot peening method (b) may have compressive residual stress of about 500 MPa regardless of the depth. On the other hand, in the forging treatment method (d) using the ultra-fine steel balls, compressive residual stress may be concentrated on a small depth and compressive residual stress of up to 1600 MPa may be concentrated.

That is, by using the forging treatment method using ultra-fine steel balls, it is possible to form a condensed improved by about three times or more compared to the shot peening method.

For reference, (a) shows an untreated case and (c) shows the case of performing a hard peening method.

Figure 21:
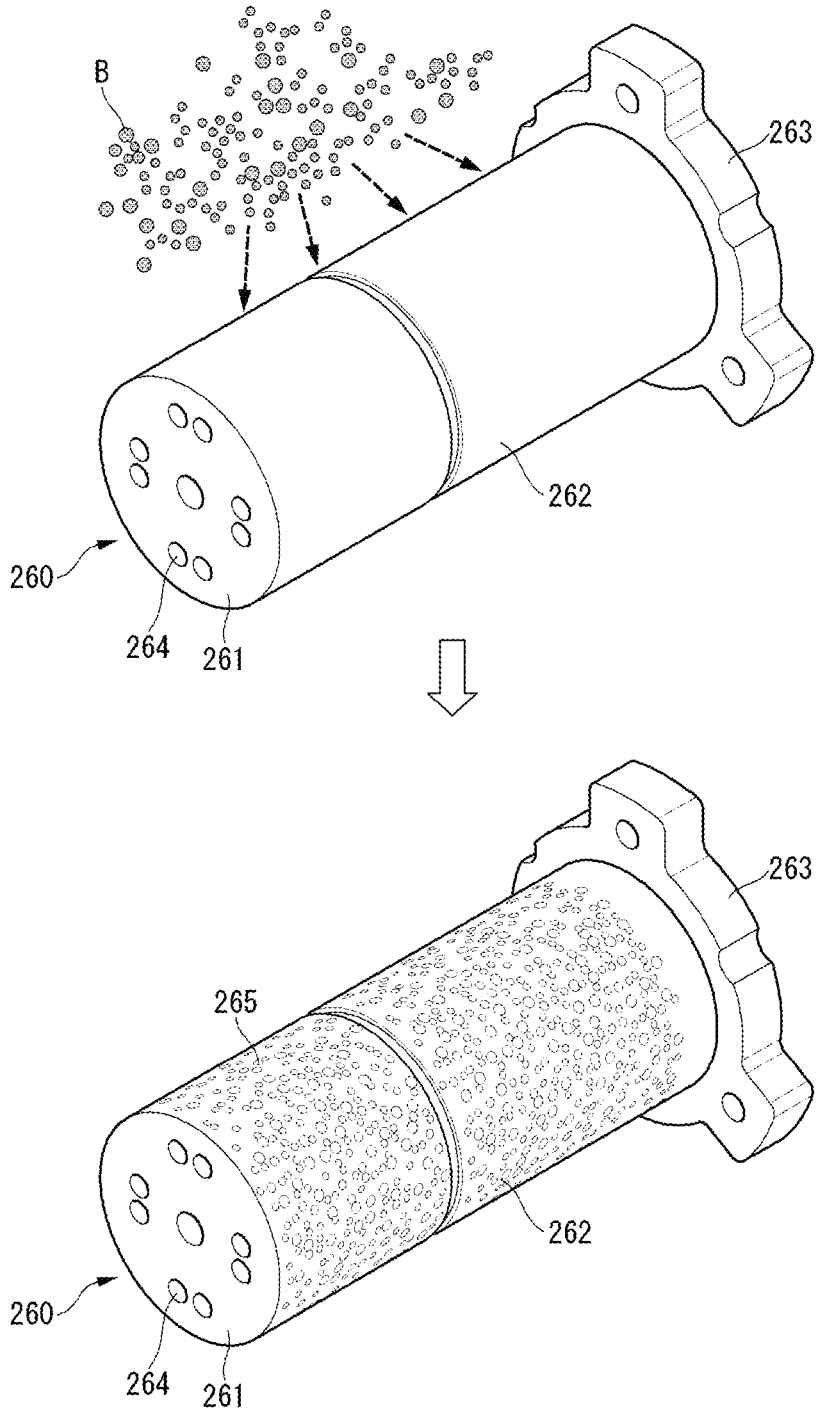
FIG. 21 is a view showing a state in which fine grooves are formed in an entire surface of a piston.
Figure 22:
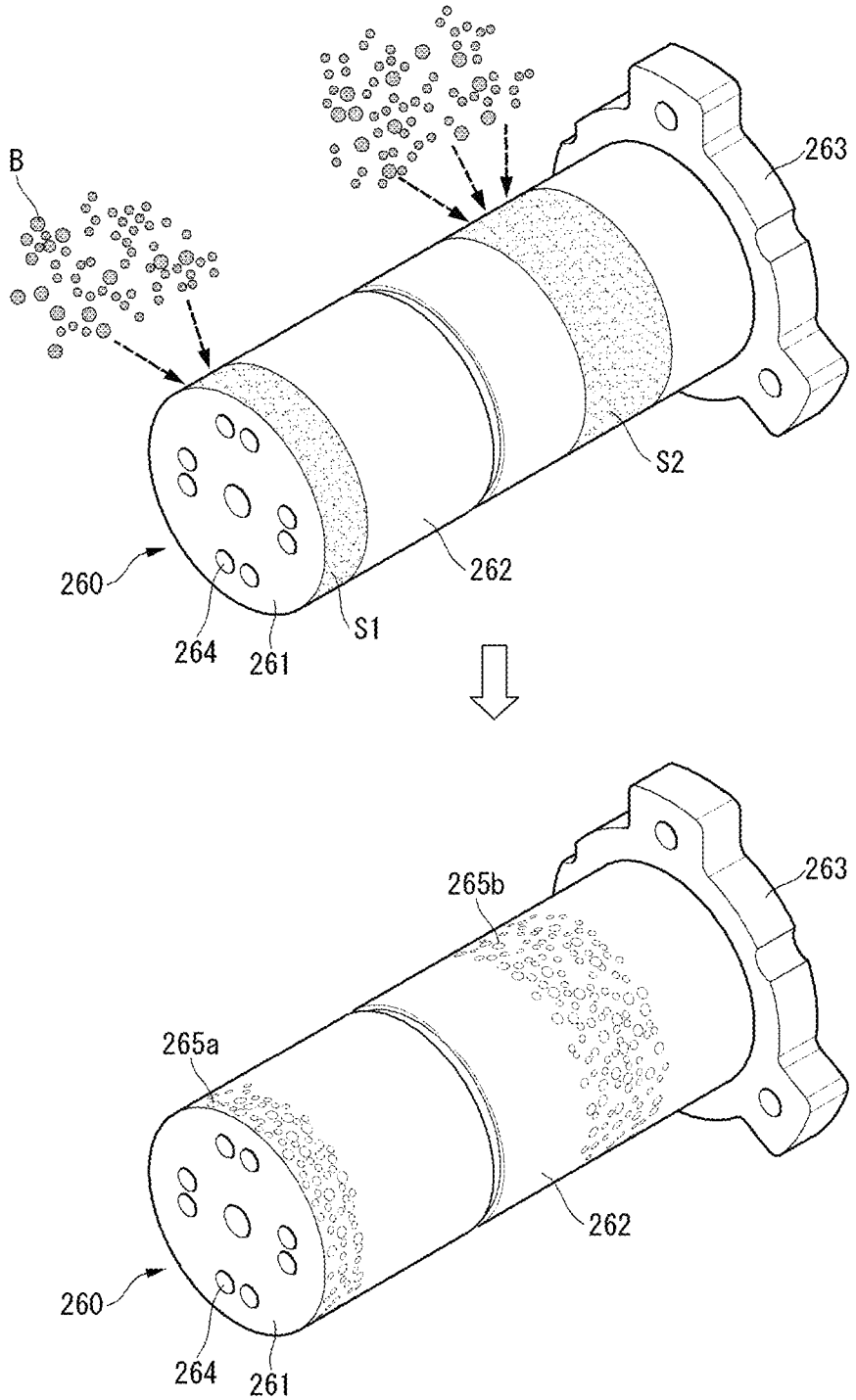
FIG. 22 is a view showing a state in which fine grooves are locally formed in front and rear sides of a piston.

FIG. 21 is a view showing a state in which fine grooves G are formed in an entire surface of a piston, and FIG. 22 is a view showing a state in which fine grooves G are locally formed in front and rear sides of a piston.

Referring to FIG. 21, ultra-fine steel balls having a diameter of 40 to 200 micrometers are sprayed to the surface of the guide 262 of the piston 260 at a speed of 200 m/s. As a result, fine grooves G 265 having a diameter of 10 micrometers and a depth of 5 micrometers are formed in the surface of the guide 262.

Meanwhile, the size of the steel balls B may be smaller. For example, the ultra-fine steel balls B having a diameter of 10 to 50 micrometers may be sprayed at a speed of 200 m/s or more. Alternatively, as the diameter of the steel balls B decreases, by spraying the steel balls at a lower speed, the fine grooves G having the same size may be formed.

The fine grooves G 265 formed by the ultra-fine steel balls B may be formed to have a shape of a portion of a sphere.

In order to provide uniform compressive residual stress in the circumferential direction of the guide 262, it is necessary to repeat the process of spraying the steel balls B while rotating the piston 260 around the driving shaft.

Referring to FIG. 22, a front lubrication surface S1 located at a front portion and a rear lubrication surface S2 located at a rear portion may be formed in the surface of the guide 262 of the piston 260.

The front lubrication surface S1 may be located closer to the head 261 than the center of the guide 262 in the longitudinal direction, and the rear lubrication surface S2 may be approximately located between the center of the guide 262 in the longitudinal direction and the flange 263.

The ultra-fine steel balls B are sprayed to the front lubrication surface S1 and the rear lubrication surface S2. This is because, when the piston 260 is eccentric or inclined in the cylinder 240, since friction is concentrated on the front lubrication surface S1 and the rear lubrication surface S2 of the guide 262 to increase compressive residual stress of this portion.

Therefore, front fine grooves G 265*a* may be formed in the front lubrication surface S1, and rear fine grooves G 265*b* may be formed in the rear lubrication surface S2.

Figure 23:
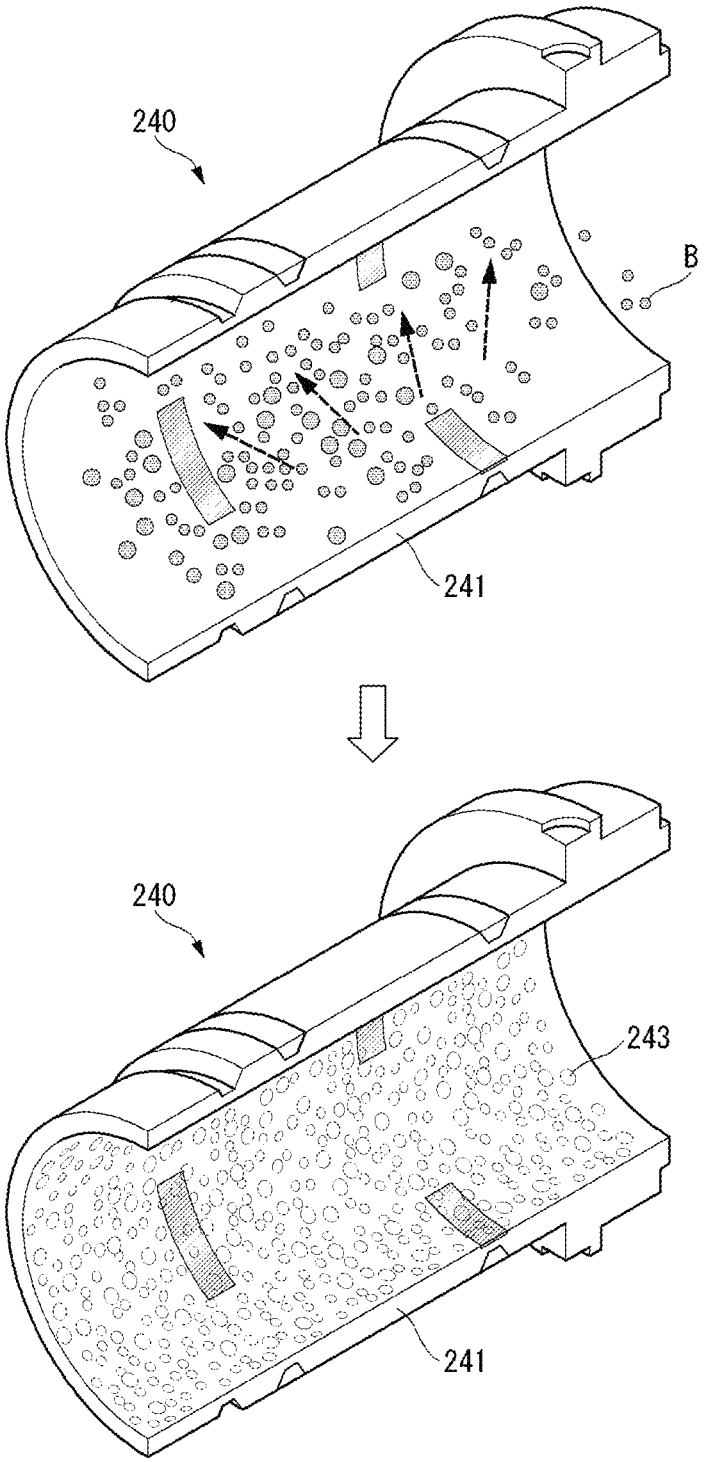
FIG. 23 is a view showing a state in which fine grooves are formed in an entire surface of a cylinder.
Figure 24:
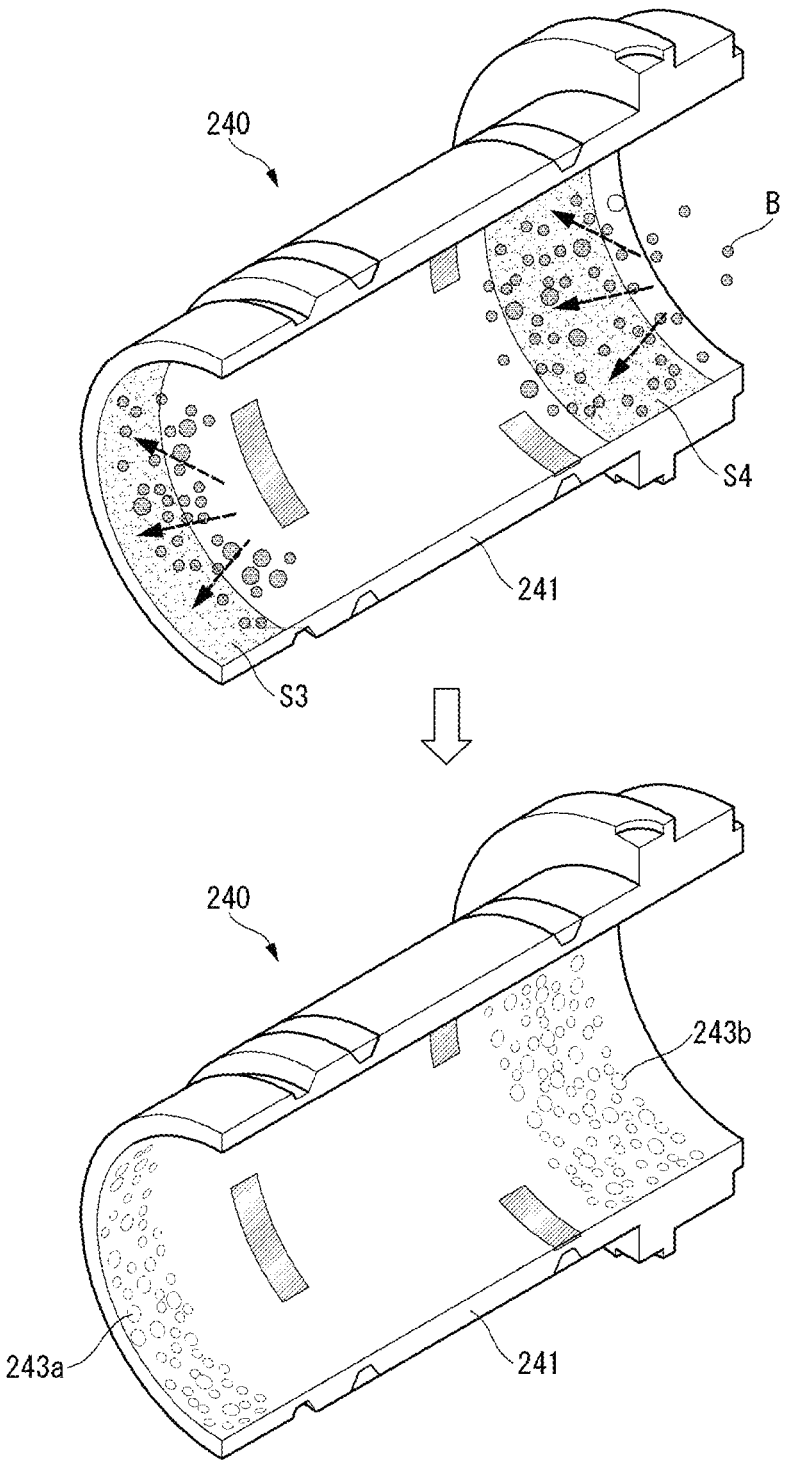
FIG. 24 is a view showing a state in which fine grooves are locally formed in front and rear sides of a cylinder.

FIG. 23 is a view showing a state in which fine grooves are formed in an entire surface of a cylinder, and FIG. 24 is a view showing a state in which fine grooves are locally formed in front and rear sides of a cylinder.

Referring to FIG. 23, ultra-fine steel balls B having a diameter of 40 to 200 micrometers are sprayed to the inner circumferential surface of the cylinder body 241 at a speed of 200 m/s. As a result, fine grooves G 243 having a depth of 10 micrometers and a depth of 5 micrometers are formed in the surface of the cylinder body 241.

Meanwhile, the size of the steel balls B may be smaller. For example, the ultra-fine steel balls B having a diameter of 10 to 40 micrometers may be sprayed at a speed of 200 m/s or more. Alternatively, as the diameter of the steel balls B decreases, by spraying the steel balls at a lower speed, the fine grooves G 243 having the same size may be formed.

In order to provide uniform compressive residual stress in the circumferential direction of the body 241, it is necessary to repeat the process of spraying the steel balls B while rotating the cylinder 240 around the driving shaft.

Referring to FIG. 24, a front lubrication surface S3 located at a front portion and a rear lubrication surface S4 located at a rear portion may be formed in the inner circumferential surface of the cylinder body 241.

For example, the front lubrication surface S3 may be located in front of the gas inlet 232 formed in the front portion of the cylinder body 241, and the rear lubrication surface S4 may be located behind the gas inlet 232 formed at the rear portion of the cylinder body 241.

The ultra-fine steel balls B are sprayed to the front lubrication surface S3 and the rear lubrication surface S4. This is because, when the piston 260 is eccentric or inclined in the cylinder 240, since friction is concentrated on the front lubrication surface S3 and the rear lubrication surface S4 of the body 241 to increase compressive residual stress of this portion.

Therefore, front fine grooves G 243*a* may be formed in the front lubrication surface S3, and rear fine grooves G 243*b* may be formed in the rear lubrication surface S2.

Meanwhile, a forging method using ultra-fine steel balls may be performed with respect to at least one of the piston 260 or the cylinder 240. As long as a manufacturing time and cost are satisfied, when the forging method using ultra-fine balls is performed with respect to both the piston 260 and the cylinder 240, it is possible to improve durability of the surface of the product.

Figure 25:
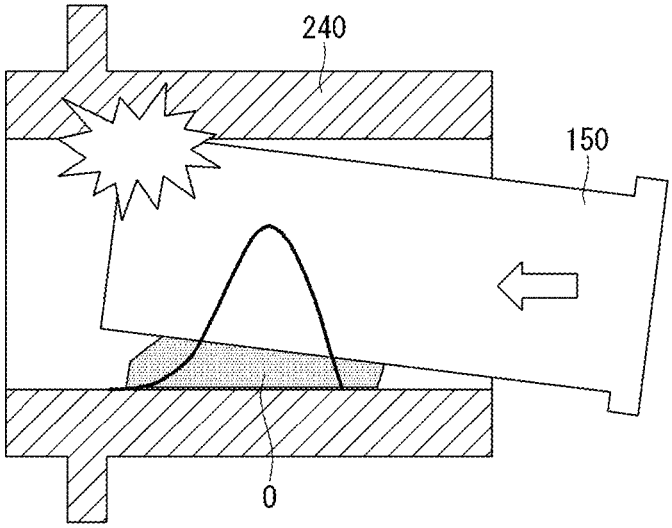
FIG. 25 is a view showing a phenomenon which may occur when oil flows into a sliding part.
Figure 25:
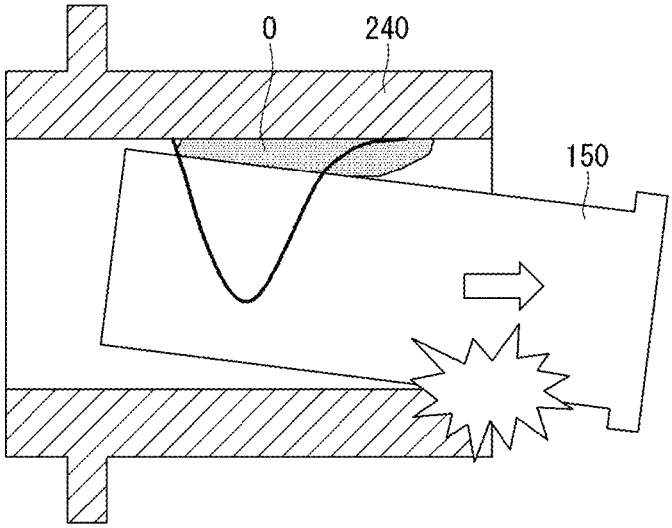
Figure 26:
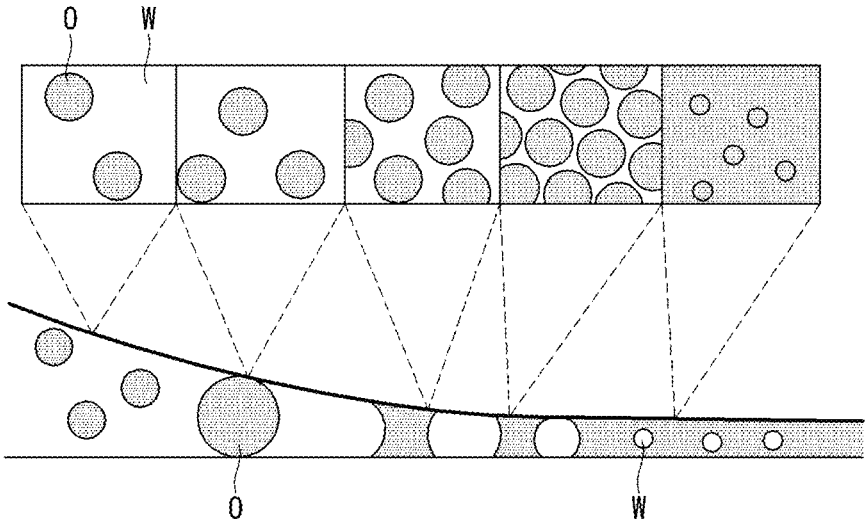
FIG. 26 is a schematic view illustrating behavior of oil permeating into a gap.

FIG. 25 is a view showing a phenomenon which may occur when oil O flows into a sliding part, and FIG. 26 is a schematic view illustrating behavior of oil O permeating into a gap.

When oil flows into the sliding part, lubrication performance of the discharge gas may rapidly decrease. This is because the introduced oil generates high dynamic pressure in the sliding part and functions as an airbag, thereby pushing the piston 150 to one side and causing contact with the inner wall of the cylinder 240. This may cause abrasion and damage of the piston 150.

In order to prevent oil from flowing into the sliding part, a plurality of sealing members is installed in the coupling structure. However, in order to use the gas bearing unit, a gas hole 224 (see FIG. 2) for introducing refrigerant gas to the sliding part is required and introduction of oil through the gas hole 224 needs to be prevented.

The discharge filter 230 for blocking foreign materials is installed in front of the gas hole 224, but, it is difficult to filter out the oil dissolved in the refrigerant due to performance limitation of the discharge filter 230. This is because the refrigerant is sucked through the suction pipe in a gas state, but the refrigerant may be partially phase-transformed in a high-pressure, low-temperature portion in the compressor 200, and oil may be dissolved around the phase-transformed refrigerant. For example, even when the discharge filter 230 having best performance is installed, it is impossible to filter out oil dissolved in r600a refrigerant.

The oil dissolved in the refrigerant may generate an oil lump between the frame 220 and the cylinder 240, and the generated oil lump may flow into the sliding part, causing a problem. For reference, since oil has a smaller surface tension than water, when oil is in contact with the surface of a solid, a contact angle is very small and thus oil may easily pass through a relatively narrow gap.

Referring to (a) of FIG. 25, when oil O is generated in the lower portion of the sliding part, oil O functions as an airbag during the compression cycle of the piston 150 to generate force to move the front portion of the piston 150 up, and the front upper portion of the piston 150 comes into contact with the front upper portion of the inner wall of the cylinder 240.

Referring to (b) of FIG. 25, when oil O is generated in the upper portion of the sliding part, oil O functions as an airbag during the suction cycle of the piston 150 to generate force to move the rear portion of the piston 150 downward, and the rear lower portion of the piston 150 comes into contact with the rear lower portion of the inner wall of the cylinder 240.

Referring to FIG. 26, it can be seen that, when oil O is mixed with water W, oil O may permeate into a narrow gap. This is because oil O has smaller surface tension than water W. Fine oil droplets O are collected and grown around the narrow gap and the oil droplets O having small surface tension are sucked into the narrow gap due to a pressure difference. The narrow gap is filled with the permeated oil O containing moisture W in the state of fine droplets.

Figure 27:
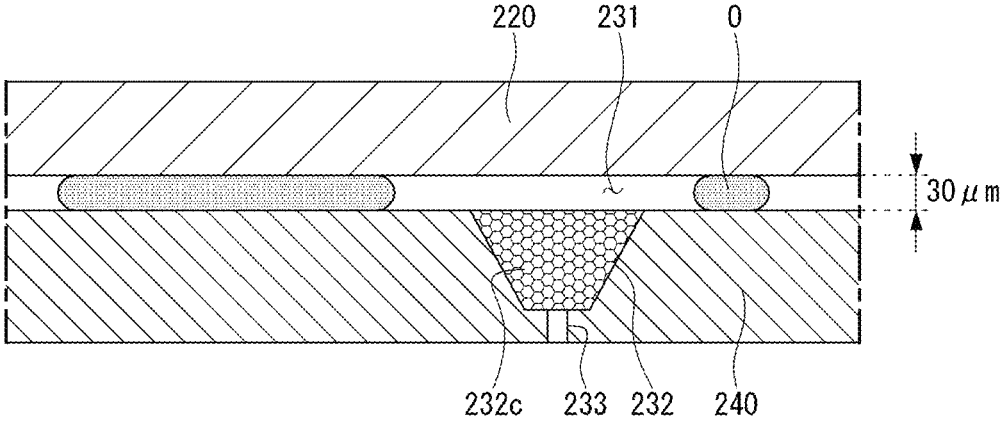
FIG. 27 is a view illustrating a phenomenon wherein oil does not flow into a cylinder due to friction.

FIG. 27 is a view illustrating a phenomenon wherein oil does not flow into a cylinder 240 due to friction.

Referring to FIG. 27, the space of the gas pocket 231, that is, the distance between the outer circumferential surface of the cylinder body 241 and the inner circumferential surface of the frame body 221 may be in a range of 10 micrometers to 30 micrometers.

When the space of the gas pocket 231 is less than 30 micrometers, oil o does not flow into the gas inlet 232 by surface friction force of the gas pocket 231. The surface friction force of oil increases as the space of the gas pocket 231 decreases, which is related to compression of oil o as the space of the gas pocket 231 decreases. That is, when the space of the gas pocket 231 is 30 micrometers, the magnitude of the frictional force of oil o and the stress applied to oil o are the same or the magnitude of the frictional force becomes larger.

In addition, oil o collected in the gap of the gas pocket 231 may also function as a filter for filtering out foreign materials moving to the sliding part.

In addition, when the space of the gas pocket 231 is equal to or greater than 10 micrometers, the pressure drop in the region of the gas inlet 232 is 0.35 bar, which satisfies a lubrication criterion.

In a structure for preventing oil from permeating into the sliding part by reducing assembly tolerance between the cylinder 240 and the frame 220, a specific part is not added or a machining process is not added, thereby improving reliability without increasing cost.

Figure 28:
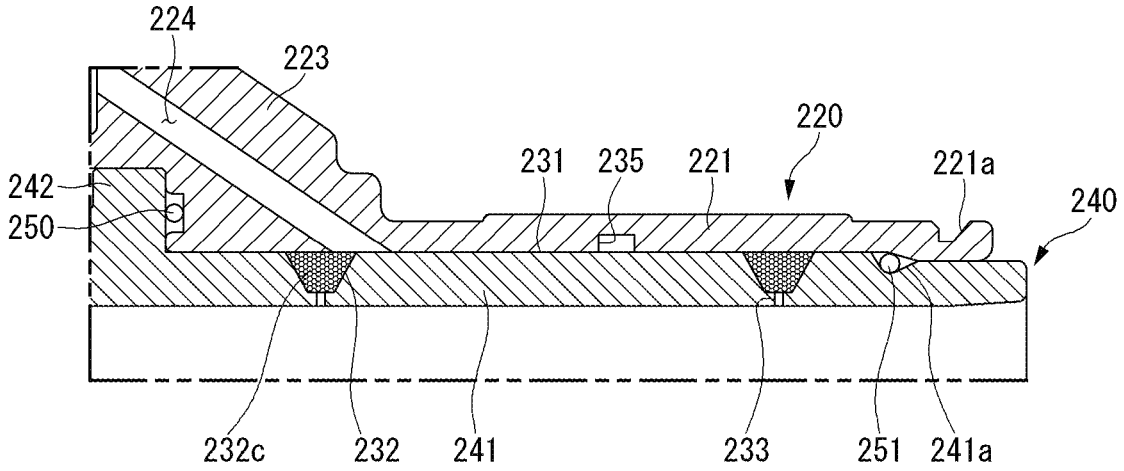
FIG. 28 is a cross-sectional view showing a modified embodiment of FIG. 27.

FIG. 28 is a cross-sectional view showing a modified embodiment of FIG. 27.

Referring to FIG. 28, a collection groove 235 may be formed in the inner circumferential surface of the frame body 221 to collect oil or foreign materials of the gap of the gas pocket 231. The collection groove 235 may be recessed from the inner circumferential surface of the frame body 221 in the radial direction.

The collection groove 235 may be located to be spaced apart from the gas inlet 232 in the axial direction. For example, the collection groove 235 may be formed between the gas inlet 232 located at the front portion of the cylinder body 241 and the gas inlet 232 located at the rear portion of the cylinder body 241.

The collection groove 235 may extend in the circumferential direction. The collection groove 235 may be formed in a circular shape to extend 360 degrees and a plurality of collection grooves may be provided to be spaced apart from each other in the circumferential direction.

The collection groove 235 may be formed in the inner circumferential surface of the frame body 221 or the outer circumferential surface of the cylinder body 241. However, in order to prevent deformation of the cylinder 240, the collection grove is preferably formed in the inner circumferential surface of the frame body 221.

In addition, the depth of the collection groove 235 may be greater than the space of the gas pocket 231.

Since the collection groove 235 has a relatively larger depth than the space of the gas pocket 231, the oil or foreign materials collected in the collection groove 235 may remain in the collection groove 235, without flowing into the gas pocket 231 again.

Figure 29:
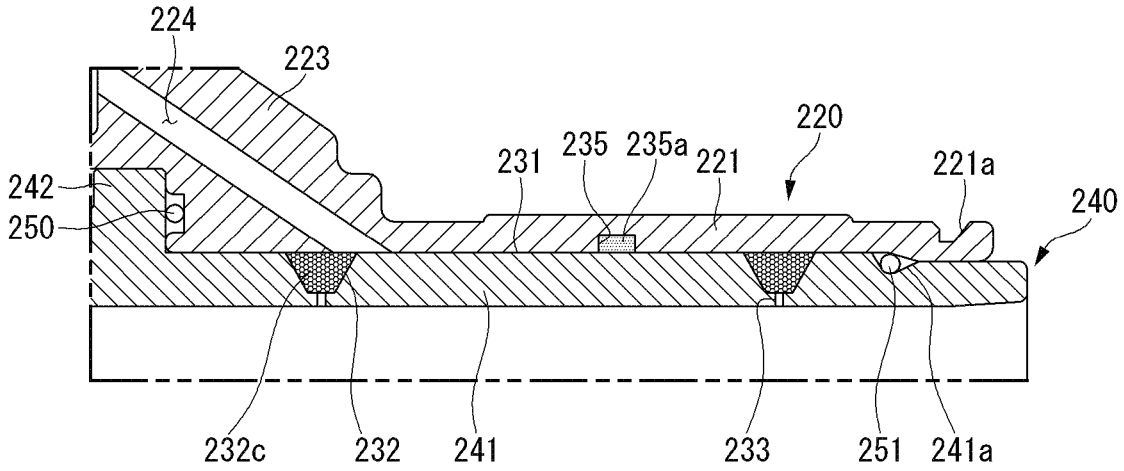
FIG. 29 is a cross-sectional view showing another modified embodiment.

FIG. 29 is a cross-sectional view showing another modified embodiment of FIG. 27.

Referring to FIG. 29, a porous material 235*a* capable of absorbing oil or foreign materials may be inserted into the collection groove 235. The porous material 235*a* may be provided in a shape corresponding to the shape of the collection groove 235.

For example, when the collection groove 235 extends 360 degrees in the circumferential direction, the porous material 235*a* may be provided in a ring shape.

The porous material 235*a* may be designed to minimize flow resistance of the refrigerant gas while absorbing oil or foreign materials. For example, the porous material 235*a* may have a void such that only particles having a diameter of 5 micrometers pass.

Certain or other embodiments of the present disclosure described above are not mutually exclusive or distinct. The components or functions of certain or other embodiments of the present disclosure described above may be combined.

For example, a component A described in a specific embodiment and/or a drawing may be combined with a component B described in another embodiment and/or a drawing. That is, even if the combination of the components is not directly described, the combination is possible except for the case where the combination is described as being impossible.

The above exemplary embodiments are therefore to be construed in all aspects as illustrative and not restrictive. The scope of the invention should be determined by the appended claims and their legal equivalents, not by the above description, and all changes coming within the meaning and equivalency range of the present disclosure are intended to be embraced therein.

In the compressor and the method of manufacturing the same according to the present disclosure, by forging the lubrication surface of the piston or the cylinder using ultra-fine steel balls, it is possible to improve durability of abrasion without a separate coating process, reducing friction loss, and improving compression reliability.

In addition, according to at least one of the embodiments of the present disclosure, by forging only the front and rear ends in which abrasion frequently occurs due to contact using the ultra-fine steel balls instead of the entire lubrication surface, it is possible to save a processing time and cost.

In addition, according to at least one of the embodiments of the present disclosure, by reducing assembly tolerance between the cylinder and the frame, it is possible to prevent oil introduced through the gas inlet from moving to the sliding part. Therefore, since this reduces a gap between the cylinder and the frame and increases surface frictional force applied to oil, it is possible to prevent oil from moving in the gas inlet. By the compressor according to the present disclosure, it is possible to improve durability and reliability by minimizing contact between the piston and the cylinder.

In addition, according to at least one of the embodiments of the present disclosure, it is possible to prevent oil or foreign materials flowing into the gas inlet from moving to the sliding part, by collecting the oil or the foreign materials.

In addition, according to at least one of the embodiments of the present disclosure, it is possible to maintain the restrictor function regardless of mistakes of the coupling process of the cylinder and durability problems over time and to prevent contaminants or oil from moving to the supply port.

What is claimed is:

1. A compressor comprising:

a piston that defines a suction space configured to suction a refrigerant gas; and a cylinder that receives the piston and defines a compression space that is configured to compress, based on reciprocation of the piston in an axial direction, the refrigerant gas therein, wherein a plurality of recesses are defined at an inner circumferential surface of the cylinder, wherein the plurality of recesses each have a partial spherical shape and have a diameter of 10 micrometers or less, wherein the cylinder includes a first gas inlet that fluidly communicates with an internal space of the cylinder at a first opposite side of the gas inlet, wherein a plurality of second gas inlets are recessed at an outer circumferential surface of the cylinder and spaced apart from each other in the axial direction is disposed in the axial direction, wherein the cylinder further includes a plurality of gas receiving grooves that fluidly communicate with the gas inlets, that are recessed at the inner circumferential surface of the cylinder, and that are spaced apart from each other in the axial direction, and wherein the plurality of gas receiving grooves are arranged in a concave curved shape with a radius of curvature less than a radius of curvature of the inner circumferential surface of the cylinder such that the plurality of gas receiving grooves have a depth that changes continuously along a circumferential direction of the cylinder.

2. The compressor of claim 1, further comprising:

a frame that receives the cylinder, wherein the piston is configured to move to perform a compression cycle and a suction cycle, wherein the piston comprises:

a head that defines a suction port that fluidly communicates with the suction space and the compression space, and a guide that faces the inner circumferential surface of the cylinder and has a cylindrical shape, wherein the cylinder comprises:

a body that defines a piston space that receives the piston, and a flange that is located at a first end of the body and that is coupled with the frame, and wherein a plurality of grooves are defined at an outer circumferential surface of the piston and are defined at (i) a first outer region of the piston adjacent to the head, (ii) a second outer region of the piston that corresponds to a second end of the body of the cylinder based on the piston being in the compression cycle, and (iii) a third outer region of the piston that is adjacent to the second end of the body of the cylinder based on the piston being in the compression cycle, wherein the second end of the body is opposite to the first end of the body.

3. The compressor of claim 1, wherein the piston is configured to move to perform a compression cycle and a suction cycle, wherein the piston comprises:

a head that defines a suction port that fluidly communicates with the suction space and the compression space, and a guide that faces the inner circumferential surface of the cylinder and has a cylindrical shape, wherein the cylinder comprises:

a body that defines a piston space that receives the piston, and a flange that is located at a first end of the body and that is coupled with a frame, and wherein the plurality of recesses that are defined at the inner circumferential surface of the cylinder are defined at (i) a first inner region of the cylinder that corresponds to a first end of the guide of the piston based on the piston being in the compression cycle, (ii) a second inner region of the cylinder that is adjacent to the first end of the guide of the piston based on the piston being in the compression cycle, and (iii) a third inner region of the cylinder that is adjacent to a second end of the body that is opposite to the first end of the body.

4. The compressor of claim 1, further comprising a frame that receives the cylinder, wherein a gas pocket is defined between an inner circumferential surface of the frame and the outer circumferential surface of the cylinder, and is configured to allow the refrigerant gas to flow through the gas pocket, wherein the frame includes a gas hole that (i) fluidly communicates with an outside of the frame at a side of the gas hole and that allows the refrigerant gas to flow into the outside of the frame, and (ii) fluidly communicates with the gas pocket at an opposite side of the gas hole, wherein the first gas inlet that fluidly communicates with the gas pocket at a side of the first gas inlet, and wherein a distance between the inner circumferential surface of the frame and the outer circumferential surface of the cylinder that define the gas pocket is in a range of 10 to 30 micrometers.

5. The compressor of claim 4, wherein the frame comprises:

a frame body that receives the cylinder and that has a cylindrical shape, and a frame flange that extends radially outward from a first portion of the frame body and that is connected with a driver configured to move the piston, and wherein the gas hole has a first side that fluidly communicates with the first portion of the frame flange and a second side that is opposite to the first side of the gas hole and fluidly communicates with an inside of the frame body.

6. The compressor of claim 4, further comprising:

a first sealing member that is disposed between the cylinder and the frame at a first portion of the gas hole and that is configured to seal a first portion of the gas pocket; and a second sealing member that is disposed between the cylinder and the frame at a second portion of the gas hole and that is configured to seal a second portion of the gas pocket, wherein the gas pocket includes a gas space between the first sealing member and the second sealing member.

7. The compressor of claim 6, wherein at least one of the plurality of second gas inlets at least partially overlaps the opposite side of the gas hole.

8. The compressor of claim 7, wherein each of the plurality of second gas inlets extends in a circumferential direction along the outer circumferential surface of the cylinder.

9. The compressor of claim 8, wherein the plurality of gas receiving grooves circumferentially extend along the inner circumferential surface of the cylinder at an angle of 180 degrees or less with respect to a central axis of the cylinder.

10. The compressor of claim 9, wherein the plurality of gas receiving grooves is provided in the axial direction and is offset from each other in the axial direction.

11. The compressor of claim 1, wherein the plurality of recesses each have a diameter that ranges between 1 micrometer and 10 micrometers.

* * * * *